US006405005B1

(12) United States Patent
Kitamura et al.

(10) Patent No.: US 6,405,005 B1
(45) Date of Patent: Jun. 11, 2002

(54) PROCESS CARTRIDGE AND ELECTROPHOTOGRAPHIC APPARATUS

(75) Inventors: Wataru Kitamura, Tokyo; Osamu Tamura, Kashiwa; Yoshihisa Saito, Fujishiro-machi, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/629,417

(22) Filed: Jul. 31, 2000

Related U.S. Application Data

(62) Division of application No. 09/300,479, filed on Apr. 28, 1999.

(30) Foreign Application Priority Data

Apr. 30, 1998 (JP) ..... 10-120322
Apr. 30, 1998 (JP) ..... 10-121384

(51) Int. Cl.[7] ..... G03G 15/00; G03G 15/147
(52) U.S. Cl. ..... 399/159; 430/66; 430/67
(58) Field of Search ..... 430/66, 110, 970, 430/67, 108.7, 108.6, 108.1; 399/176, 115, 174, 159

(56) References Cited

U.S. PATENT DOCUMENTS

| | | | | |
|---|---|---|---|---|
| 3,837,851 A | | 9/1974 | Shattuck et al. | 96/1.5 |
| 3,871,880 A | | 3/1975 | Montillier | 96/1.5 |
| 5,008,706 A | * | 4/1991 | Ohmori et al. | 355/219 |
| 5,492,786 A | | 2/1996 | Sugimura et al. | 430/59 |
| 5,721,081 A | * | 2/1998 | Takagi et al. | 430/970 |
| 5,800,955 A | * | 9/1998 | Kashimura et al. | 430/66 |
| 5,876,890 A | | 3/1999 | Kitamura et al. | 430/59 |
| 5,976,750 A | * | 11/1999 | Hagi et al. | 430/110 |
| 5,994,011 A | | 11/1999 | Kashimura | 430/66 |

FOREIGN PATENT DOCUMENTS

| | | |
|---|---|---|
| EP | 0 589 776 | 3/1994 |
| EP | 0 677 794 | 10/1995 |
| EP | 0 903 604 | 3/1999 |
| JP | 56-167759 | 12/1981 |
| JP | 57-017826 | 1/1982 |
| JP | 58-040566 | 3/1983 |
| JP | 61-228453 | 10/1986 |
| JP | 61-272754 | 12/1986 |
| JP | 62-160458 | 7/1987 |
| JP | 63-149668 | 6/1988 |

OTHER PUBLICATIONS

Database WPI, Section Ch, Wk. 8818, Derwent Publ. A.N. 88–122320 (corresponds to JP 63–065449, Mar. 1988).

* cited by examiner

*Primary Examiner*—Christopher Rodee
(74) *Attorney, Agent, or Firm*—Fitzpatrick, Cella, Harper & Scinto

(57) ABSTRACT

A process cartridge is disclosed which includes an electrophotographic photosensitive member having a photosensitive layer and a charging means. The charging means has a charging member which is provided in contact with the electrophotographic photosensitive member to charge the photosensitive member electrostatically by applying a voltage formed by superimposing an alternating-current voltage on a direct-current voltage. The photosensitive member has a surface layer which contains at least one of a polyarylate resin having a weight-average molecular weight of $7.5\times10^3$ to $3.7\times10^4$ and having a specific structural unit of Formula (1) and a polycarbonate resin having a weight-average molecular weight of $7.5\times10^3$ to $3.7\times10^4$ and having a specific structural unit of Formula (2). The photosensitive member further contains fluorine-containing resin particles. Also, an electrophotographic apparatus having the photosensitive member is disclosed.

26 Claims, 2 Drawing Sheets

PROCESS CARTRIDGE AND ELECTROPHOTOGRAPHIC APPARATUS

This is a division of copending Application Ser. No. 9/300,479, filed Apr. 28, 1999.

BACKGROUND OF THE INVENTION

1. Field of the Invention

This invention relates to a process cartridge and an electrophotographic apparatus which have a charging means and an electrophotographic photosensitive member. More particularly, it relates to a process cartridge and an electrophotographic apparatus which have a specific charging member and an electrophotographic photosensitive member having a surface layer containing a specific resin and fluorine-containing resin particles.

2. Related Background Art

In recent years, electrophotographic photosensitive members having various organic photoconductive compounds have been widely investigated. For example, U.S. Pat. No. 3,837,851, discloses a photosensitive member having a charge transport layer containing triarylpyrazoline, and U.S. Pat. No. 3,871,880 discloses a photosensitive member comprising a charge generation layer and a charge transport layer, the former containing a derivative of a perylene pigment and the latter being formed of a condensation product of 3-propylene with formaldehyde.

The organic photoconductive compounds have their own different wavelength regions where they are sensitive. For example, Japanese Patent Applications laid-open No. 61-272754 and No. 56-167759 disclose compounds having a high sensitivity at the visible region, and Japanese Patent Applications Laid-open No. 57-19567 and No. 61-228453 disclose compounds having a sensitivity at the infrared region. Of these compounds, those having a sensitivity at the infrared region are used in laser beam printers (hereinafter "LBP") and LED printers, and the demand for them and their use are increasing.

As for the charging means, Japanese Patent Applications Laid-open No. 57-17826 and No. 58-40566 disclose a contact charging means which charges an electrophotographic photosensitive member electrostatically by applying a voltage to a charging member provided in contact with the electrophotographic photosensitive member.

The contact charging means has advantages that it may cause ozone in a much smaller quantity than corona charging means, and the contact charging means is very economical because it does not waste electric currents. The corona charging means may waste by about 80% of electric currents which flow to a shield among those flowing to a charging assembly.

However, since in the contact charging means the contact charging member comes into contact with the electrophotographic photosensitive member, the electrophotographic photosensitive member is required to have a superior mechanical strength. For the purpose of improving charging stability, it is also proposed to use as applied voltage a voltage formed by superimposing an AC voltage on a DC voltage (Japanese Patent Application Laid-open No. 63-149668). In this method, although the charging stability is improved, electric currents flow to the electrophotographic photosensitive member in a very large quantity. As a result the scrape (amount of scrape) of the electrophotographic photosensitive member may increase to cause fog on images, bringing about an additional problem. Thus, studies were conducted to provide a means by which not only mechanical strength but also electrical strength can be improved.

However, when a surface layer of the electrophotographic photosensitive member is scraped less because of an improvement of mechanical and running performance, or when, even though more scraped to a certain extent, the surface layer has a large surface roughness, a resin having been deteriorated by oxidation and surface deposits can not completely be removed to cause a reduction of resistance on the photosensitive member surface, to cause a phenomenon where images formed are smeared and become smeared (hereinafter "smeared images"). Also, when the surface layer has a large surface roughness, the light-area potential may increase to cause a decrease in image density.

This phenomenon may particularly occur when a contact charging means is used which employs a voltage formed by superimposing an AC voltage on a DC voltage, and may further substantially occur when fully moistened paper is used as a transfer medium.

As a means for preventing the smeared images, Japanese Patent Application Laid-open No. 62-160458 discloses using both a low-molecular weight polycarbonate resin and a high-molecular weight polycarbonate resin so that a deteriorated surface layer, of the electrophotographic photosensitive member can be removed together with deposits. Such a means, however, can not be very effective because the electrophotographic photosensitive member may exhibit a larger surface roughness with use when the above specific contact charging means is employed.

SUMMARY OF THE INVENTION

An object of the present invention is to provide a process cartridge and an electrophotographic apparatus which have an electrophotographic photosensitive member having a superior running performance and also hardly causing smeared images and an increase in light-area potential.

The present invention provides a process cartridge comprising;

an electrophotographic photosensitive member comprising an electroconductive support and a photosensitive layer provided on the support; and a charging means having a charging member which is provided in contact with the electrophotographic photosensitive member and charges the electrophotographic photosensitive member electrostatically by applying a voltage formed by superimposing an alternating-current voltage on a direct-current voltage;

the electrophotographic photosensitive member and the charging means being supported as one unit and being detachably mountable to the main body of an electrophotographic apparatus; and the electrophotographic photosensitive member having a surface layer which contains i) at least one of a polyarylate resin having a weight-average molecular weight of from $7.5\times10^3$ to $3.7\times10^4$ and having a structural unit represented by the following Formula (1) and a polycarbonate resin having a weight-average molecular weight of from $7.5\times10^3$ to $3.7\times10^4$ and having a structural unit represented by the following Formula (2), and ii) fluorine-containing resin particles (1)

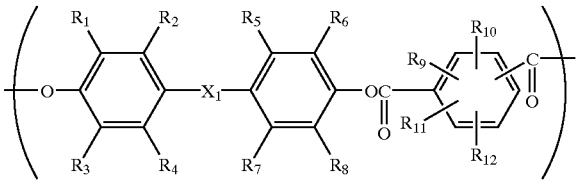

wherein $X_1$ represents —$CR_{13}R_{14}$— (where $R_{13}$ and $R_4$ are the same or different and each represent a hydrogen atom, a trifluoromethyl group, a substituted or unsubstituted alkyl group or a substituted or unsubstituted aryl group), a substituted or unsubstituted cycloalkylidene group, a substituted or unsubstituted α,ω-alkylene group, a single bond, —O—, —S—, —SO— or —$SO_2$—; and $R_1$ to $R_{12}$ are the same or different and each represent a hydrogen atom, a halogen atom, a substituted or unsubstituted alkyl group or a substituted or unsubstituted aryl group;

(2)

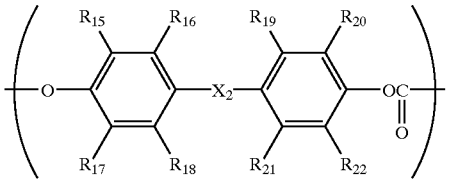

wherein $X_2$ represents —$CR_{23}R_{24}$— (where $R_{23}$ and $R_{24}$ are the same or different and each represent a hydrogen atom, a trifluoromethyl group, a substituted or unsubstituted alkyl group or a substituted or unsubstituted aryl group), a substituted or unsubstituted cycloalkylidene group, a substituted or unsubstituted ≠,ω-alkylene group, a single bond, —O—, —S—, —SO— or —$SO_2$—; and $R_{15}$ to $R_{22}$ are the same or different and each represent a hydrogen atom, a halogen atom, a substituted or unsubstituted alkyl group or a substituted or unsubstituted aryl group.

The present invention also provides an electrophotographic apparatus comprising;

an electrophotographic photosensitive member comprising an electroconductive support and a photosensitive layer provided on the support;

a charging means having a charging member which is provided in contact with the electrophotographic photosensitive member and charges an electrophotographic photosensitive member electrostatically by applying a voltage formed by superimposing an alternating-current voltage on a direct-current voltage;

an exposure means for exposing to light the electrophotographic photosensitive member charged, to form an electrostatic latent image;

a developing means for developing the electrostatic latent image by the use of a toner, to form a toner image; and transferring to a transfer medium the toner image formed;

the electrophotographic photosensitive member having a surface layer which contains i) at least one of a polyarylate resin having a weight-average molecular weight of from $7.5\times10^3$ to $3.7\times10^4$ and having a structural unit represented by the following Formula (1) and a polycarbonate resin having a weight-average molecular weight of from $7.5\times10^3$ to $3.7\times10^4$ and having a structural unit represented by the following Formula (2), and ii) fluorine-containing resin particles (1)

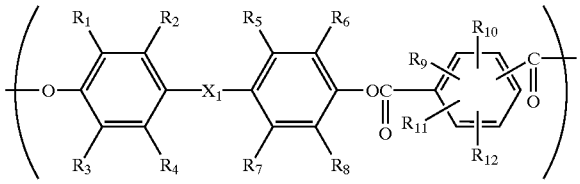

wherein $X_1$ represents —$CR_{13}R_{14}$— (where $R_{13}$ and $R_{14}$ are the same or different and each represent a hydrogen atom, a trifluoromethyl group, a substituted or unsubstituted alkyl group or a substituted or unsubstituted aryl group), a substituted or unsubstituted cycloalkylidene group, a substituted or unsubstituted α,ω-alkylene group, a single bond, —O—, —S—, —SO— or —$SO_2$—; and $R_1$ to $R_{12}$ are the same or different and each represent a hydrogen atom, a halogen atom, a substituted or unsubstituted alkyl group or a substituted or unsubstituted aryl group;

(2)

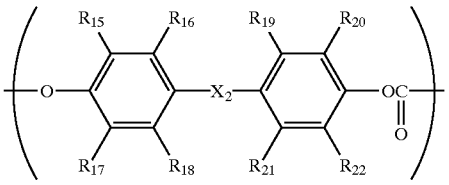

wherein $X_2$ represents —$CR_{23}R_{24}$— (where $R_{23}$ and $R_{24}$ are the same or different and each represent a hydrogen atom, a trifluoromethyl group, a substituted or unsubstituted alkyl group or a substituted or unsubstituted aryl group), a substituted or unsubstituted cycloalkylidene group, a substituted or unsubstituted α,ω-alkylene group, a single bond, —O—, —S—, —SO— or —$SO_2$—; and $R_{15}$ to $R_{22}$ are the same or different and each represent a hydrogen atom, a halogen atom, a substituted or unsubstituted alkyl group or a substituted or unsubstituted aryl group.

DESCRIPTION OF THE PREFERRED EMBODIMENTS

Figure 1:
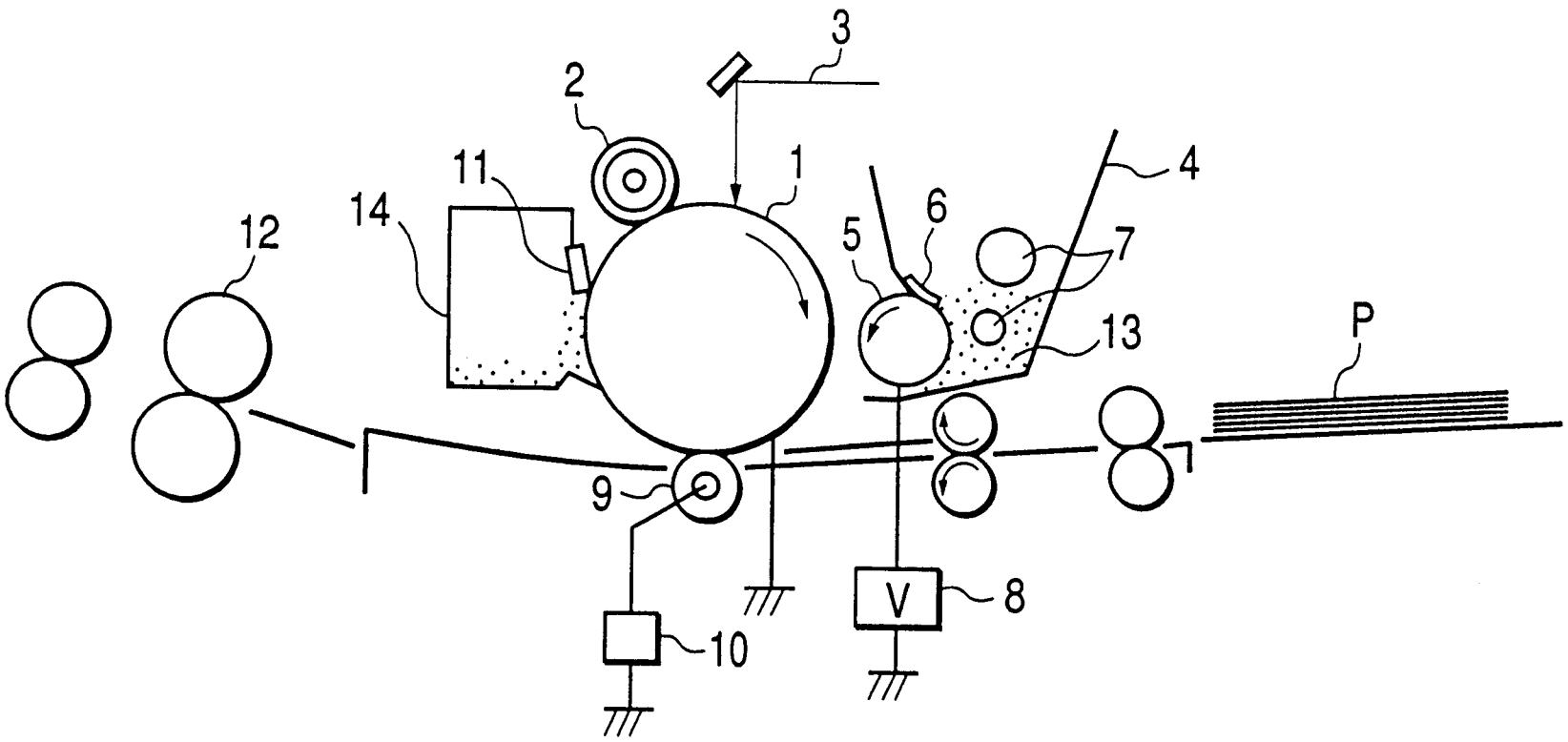
FIG. 1 schematically illustrates an example of the electrophotographic apparatus of the present invention.

The process cartridge and electrophotographic apparatus of the present invention have a charging means making use of a voltage formed by superimposing an alternating-current (AC) voltage on a direct-current (DC) voltage, and an electrophotographic photosensitive member having a surface layer which contains i) at least one of a polyarylate resin having a weight-average molecular weight of from $7.5\times10^3$ to $3.7\times10^4$ and having a structural unit represented by the following Formula (1) and a polycarbonate resin having a weight-average molecular weight of from $7.5\times10^3$ to $3.7\times$ $10^4$ and having a structural unit represented by the following Formula (2), and ii) fluorine-containing resin particles.

(1)

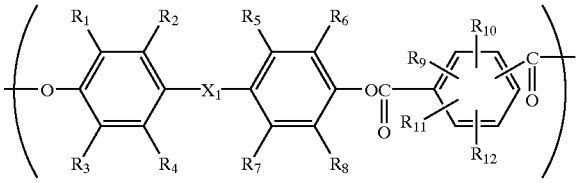

wherein $X_1$ represents —$CR_{13}R_{14}$— (where $R_{13}$ and $R_{14}$ are the same or different and each represent a hydrogen atom, a trifluoromethyl group, a substituted or unsubstituted alkyl group or a substituted or unsubstituted aryl group), a substituted or unsubstituted cycloalkylidene group, a substituted or unsubstituted α,ω-alkylene group, a single bond, —O—, —S—, —SO— or —$SO_2$—; and $R_1$ to $R_{12}$ are the same or different and each represent a hydrogen atom, a halogen atom, a substituted or unsubstituted alkyl group or a substituted or unsubstituted aryl group.

(2)

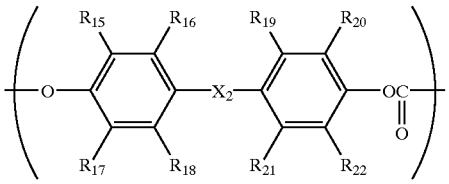

wherein $X_2$ represents —$CR_{23}R_{24}$— (where $R_{23}$ and $R_{24}$ are the same or different and each represent a hydrogen atom, a trifluoromethyl group, a substituted or unsubstituted alkyl group or a substituted or unsubstituted aryl group), a substituted or unsubstituted cycloalkylidene group, a substituted or unsubstituted ≠,ω-alkylene group, a single bond, —O—, —S—, —SO—or —$SO_2$—; and $R_{15}$ to $R_{22}$ are the same or different and each represent a hydrogen atom, a halogen atom, a substituted or unsubstituted alkyl group or a substituted or unsubstituted aryl group.

The electrophotographic photosensitive member used in the present invention uses as resins for forming the surface layer a resin having a specific molecular weight and a specific structure, and fluorine-containing resin particles. Thus, it has an electrophotographic performance which promises a superior running performance and also may hardly cause smeared images and an increase in light-area potential.

The reason why such a remarkable effect can be attained is unclear. It, however, has been confirmed that the fluorine-containing resin particles themselves have a superior releasability and, in addition thereto, the surface scraped is kept smoother than that in conventional electrophotographic photosensitive members when a resin having a relatively small molecular weight, having a superior wearability, and the fluorine-containing resin particles, effective for making coefficient of friction smaller, are used in combination. As the result, the surface deposits considered to be a cause of smeared images may hardly adhere to the surface, the exposure light may hardly be scattered, and the electrostatic capacity of the electrophotographic photosensitive member may hardly become non-uniform, as so presumed.

The polyarylate resin and polycarbonate resin used in the present invention each have a weight-average molecular weight of from $7.5\times10^3$ to $3.7\times10^4$ and may preferably have a weight-average molecular weight of from $1.0\times10^4$ to $3.7\times10^4$. Those having a weight-average molecular weight smaller than $7.5\times10^3$ may provide the surface with too low strength to tend to cause scratches in the surface upon repeated service, so that the effect against smeared images may become insufficient. Those having a weight-average molecular weight larger than $3.7\times10^4$ may make it impossible to impart any appropriate wearability to make the effect against smeared images insufficient.

These resins may have a degree of dispersion of 3.0 or below, and more preferably 2.6 or below. If they have a degree of dispersion above 3.0, those having a smaller molecular weight may be in a large proportion to cause a lowering of strength, consequently tending to cause scratches upon repeated service, so that the effect against smeared images tends to become insufficient. The degree of dispersion herein referred to is meant to be a value expressed by weight-average molecular weight/number-average molecular weight.

The molecular weight in the present invention is measured by GPC (gel permeation chromatography) using polystyrene as a reference material. An example of more detailed measuring conditions is shown below.

Apparatus: HLC-8120 (manufactured by Toso Co., Ltd.)

Columns: TSKgel Super HM-M, 6 mm, I.D. ×15 cm, two columns (available from Toso Co., Ltd.)

Reference material: Polystyrene (available from Toso Co., Ltd.)

Sample: Resin (1 part by weight)/tetrahydrofuran (1,000 parts by weight)

Flow rate: 0.6 ml/min

Solvent: Tetrahydrofuran

Temperature: 40° C.

Detector: RI, UV (254 nm)

In Formulas (1) and (2), the alkyl group may include a methyl group, an ethyl group, a propyl group, a cyclohexyl group and a cycloheptyl group. The aryl group may include a phenyl group, a naphthyl group and an anthryl group. The cycloalkylidene group may include a cyclohexylidene group, a cycloheptylidene group and a fluorenylidene group. The α,ω-alkylene group may include a 1,2-ethylene group, a 1,3-propylene group and a 1,4-butylene group. The halogen atom may include a fluorine atom, a chlorine atom and a bromine atom.

The substituent these groups may have may include halogen atoms such as a fluorine atom, a chlorine atom and a bromine atom, alkyl groups such as a methyl group, an ethyl group and a propyl group, aryl groups such as a phenyl group, a naphthyl group and an anthryl group, aralkyl groups such as a benzyl group and a phenethyl group, and alkoxyl groups such as a methoxyl group, an ethoxyl group and a propoxyl group.

What is meant by the single bond is that the benzene rings on both sides of $X_1$ or $X_2$ are directly bonded, which may include, e.g., Exemplary Structural Units (1)-7, (1)-23 and (1)-24 shown later.

Preferred examples of the structural unit of the polyarylate resin having the structural unit represented by Formula (1), used in the present invention, are shown below. Examples are by no means limited to these. Exemplary Structural units:

(1)-1
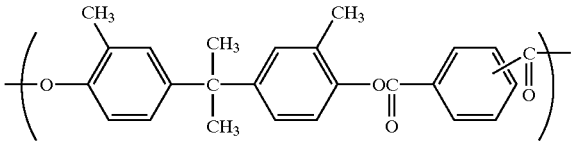
lp;1p
(1)-2
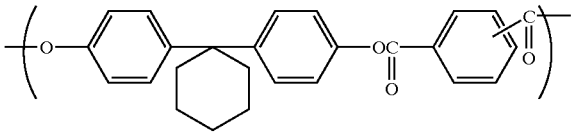
(1)-3
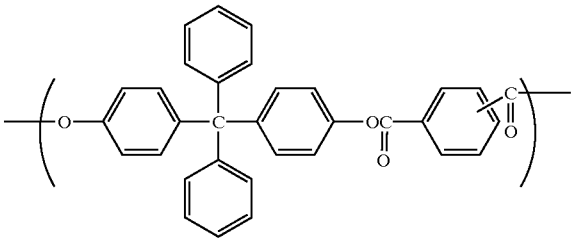
(1)-4
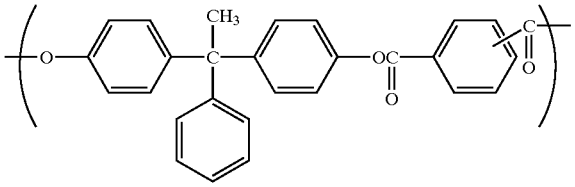
(1)-5
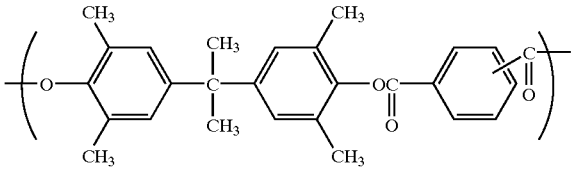
(1)-6
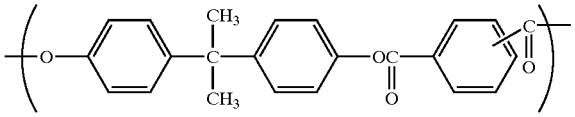
(1)-7
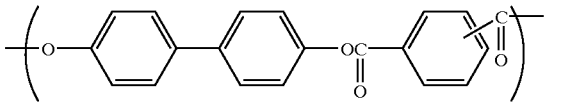
(1)-8
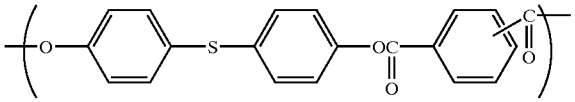
-continued
(1)-9
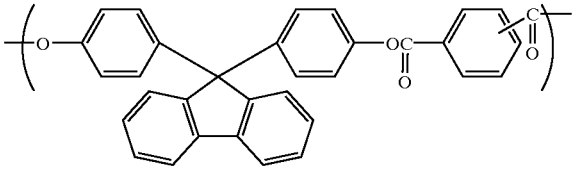
(1)-10
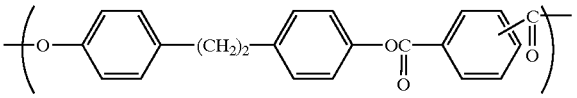
(1)-11
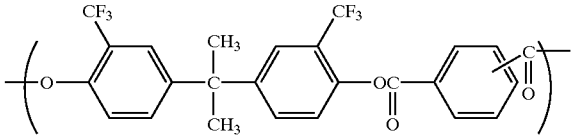
(1)-12
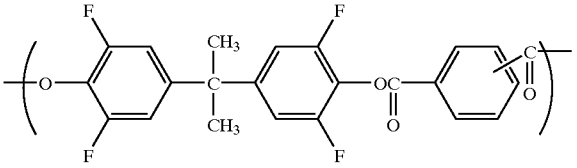
(1)-13
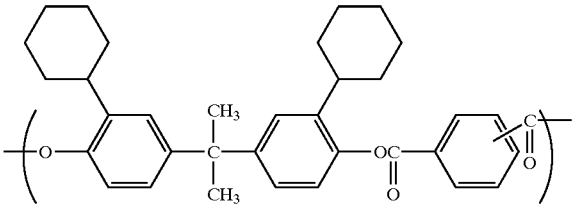
(1)-14
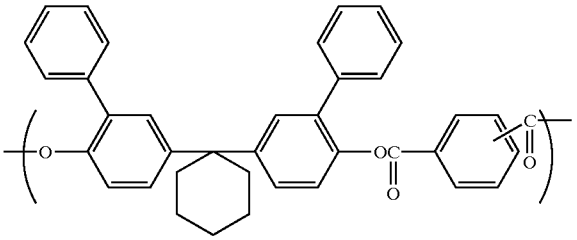
(1)-15
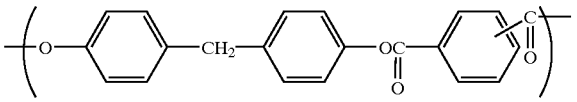
(1)-16
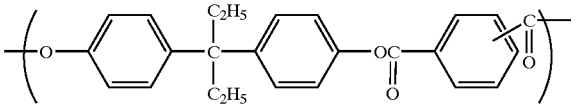
(1)-17
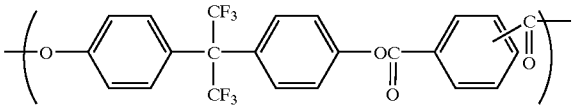

-continued (1)-18

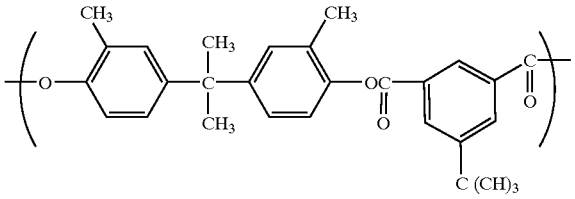

(1)-19

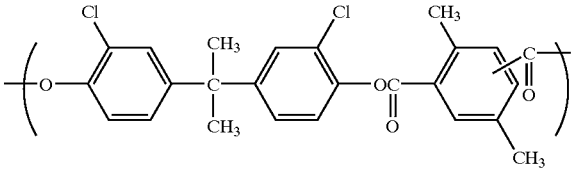

(1)-20

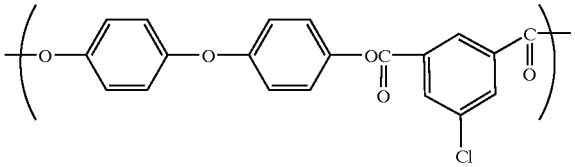

(1)-21

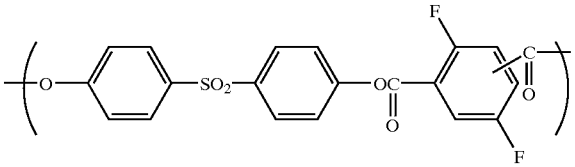

(1)-22

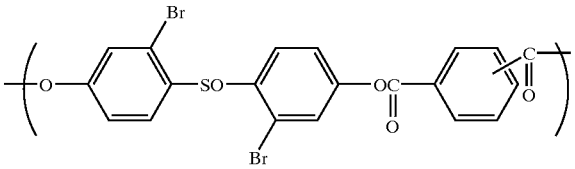

(1)-23

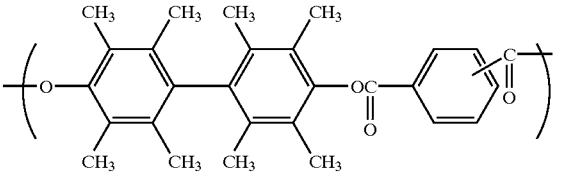

(1)-24

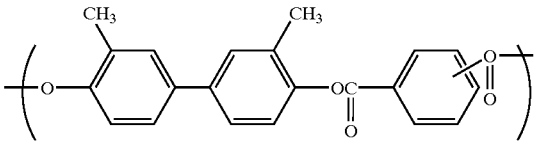

Particularly preferred examples are Exemplary Structural Units (1)-1, (1)-2, (1)-3, (1)-4 and (1)-9. Exemplary Structural Units (1)-1, (1)-2 and (1)-4 are more preferred.

The polyarylate resin having the structural unit represented by Formula (1), used in the present invention, can be synthesized by stirring a bisphenol represented by the following Formula (3) and a mixture of a terephthalic acid chloride and an isophthalic acid chloride, the mixture being usually used to improve solubility, in a solvent/aqueous system in the presence of an alkali to carry out interfacial polymerization.

(3)

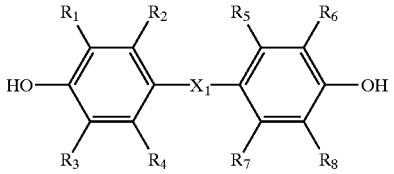

wherein $X_1$ represents —$CR_{13}R_{14}$— (where $R_{13}$ and $R_{14}$ are the same or different and each represent a hydrogen atom, a trifluoromethyl group, a substituted or unsubstituted alkyl group or a substituted or unsubstituted aryl group), a substituted or unsubstituted cycloalkylidene group, a substituted or unsubstituted α,ω-alkylene group, a single bond, —O—, —S—, —SO— or —$SO_2$—; and $R_1$ to $R_8$ are the same or different and each represent a hydrogen atom, a halogen atom, a substituted or unsubstituted alkyl group or a substituted or unsubstituted aryl group.

The terephthalic acid chloride and isophthalic acid chloride may be used in a proportion appropriately determined taking account of the solubility of the polymer. However, care must be taken since the use of any one of the chlorides in an amount of 30 mol% or less may result in an extreme decrease in solubility of the polymer synthesized. Usually, they may preferably be used in a proportion of 1/1.

In the present invention, the polyarylate resin may be either of a polymer constituted of units having the same structural unit represented by Formula (1) or a copolymer constituted of units having two or more different structural units represented by Formula (1). Also, two or more types of resins having structural units represented by Formula (1) may be blended.

Preferred examples of the structural unit of the polycarbonate resin having the structural unit represented by Formula (2), used in the present invention, are shown below. Examples are by no means limited to these. Exemplary Structural Units:

(2)-1

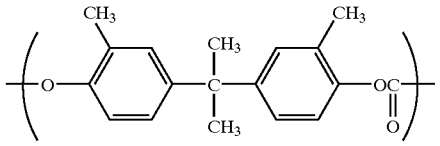

(2)-2

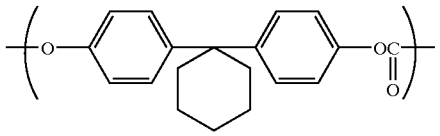

(2)-3

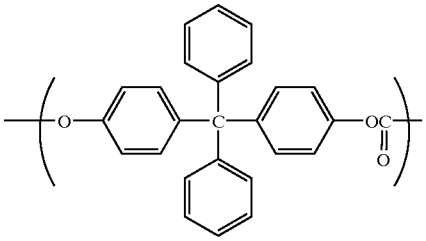

-continued
(2)-4
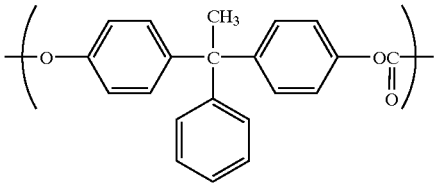
(2)-5
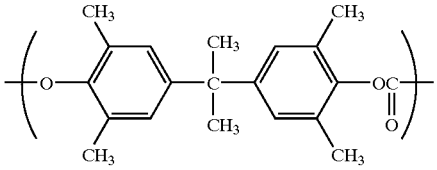
(2)-6
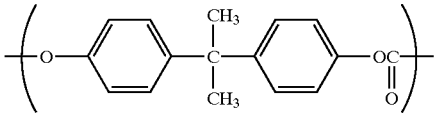
(2)-7
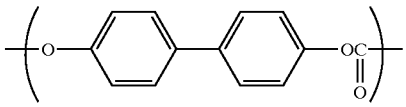
(2)-8
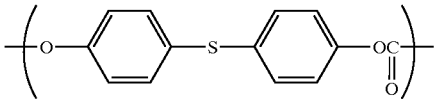
(2)-9
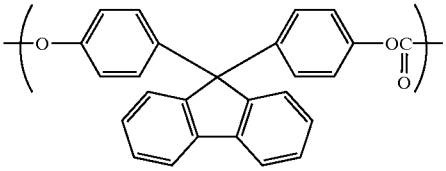
(2)-10
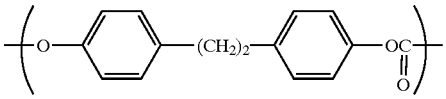
(2)-11
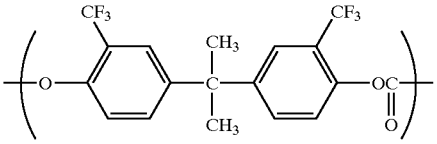
(2)-12
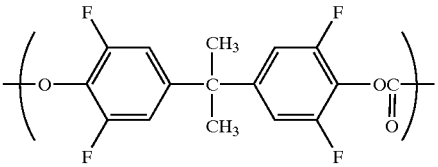
(2)-13
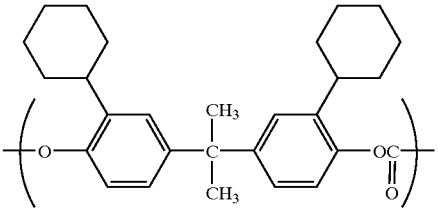
-continued
(2)-14
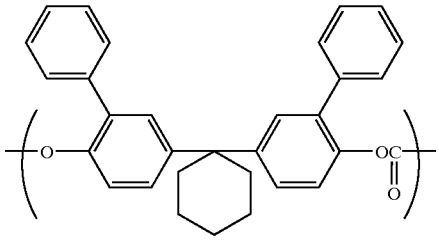
(2)-15
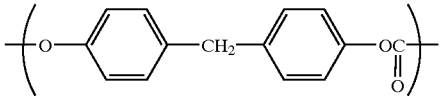
(2)-16
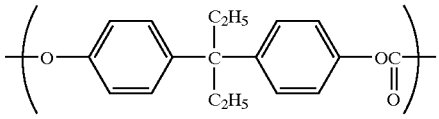
(2)-17
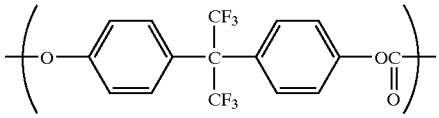
(2)-18
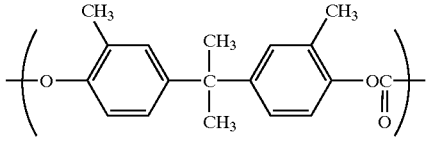
(2)-19
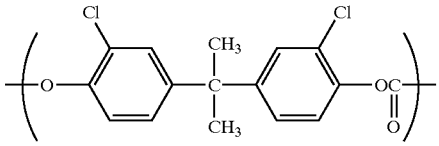
(2)-20
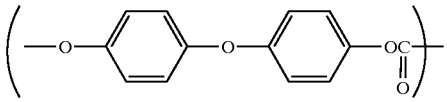
(2)-21
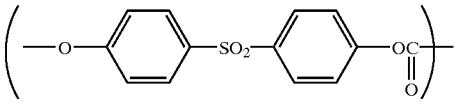
(2)-22
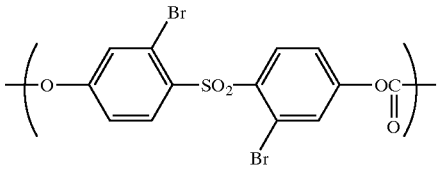
(2)-23
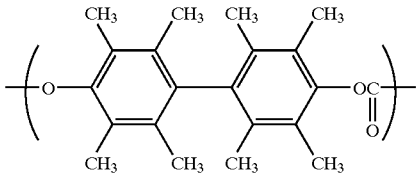

-continued (2)-24

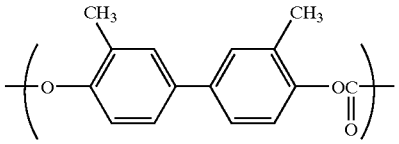

Particularly preferred examples are Exemplary Structural Units (2)-1, (2)-2, (2)-3, (2)-4 and (2)-9. Exemplary Structural Units (2)-1, (2)-2 and (2)-4 are more preferred.

The polycarbonate resin having the structural unit represented by Formula (2), used in the present invention, can usually be synthesized by allowing a bisphenol represented by the following Formula (4) to react with phosgene in the presence of an alkali to carry out polymerization.

(4)

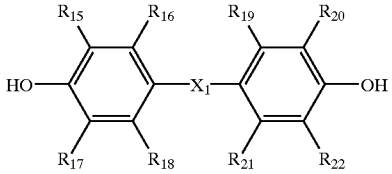

wherein $X_2$ represents —$CR_{23}R_{24}$— (where $R_{23}$ and $R_{24}$ are the same or different and each represent a hydrogen atom, a trifluoromethyl group, a substituted or unsubstituted alkyl group or a substituted or unsubstituted aryl group), a substituted or unsubstituted cycloalkylidene group, a substituted or unsubstituted α,ω-alkylene group, a single bond, —O—, —S—, —SO— or —$SO_2$—; and $R_{15}$ to $R_{22}$ are the same or different and each represent a hydrogen atom, a halogen atom, a substituted or unsubstituted alkyl group or a substituted or unsubstituted aryl group.

In the present invention, the polycarbonate resin may be either of a polymer constituted of units having the same structural unit represented by Formula (2) or a copolymer constituted of units having two or more different structural units represented by Formula (2). Also, two or more types of resins having structural units represented by Formula (2) may be blended.

In the present invention, in order to improve film strength as occasion calls, a resin having a relatively large molecular weight may preferably be used in the form of a mixture. Such a resin used therefor may preferably be a polyarylene resin having the structural unit represented by Formula (1) and a polycarbonate resin having the structural unit represented by Formula (2), and these resins may preferably have a weight-average molecular weight larger than $3.7\times10^4$ and may more preferably have a weight-average molecular weight of from $5.0\times10^4$ to $3.0\times10^5$.

Other resin may further be used in the form of a mixture. In the case when the resin of the present invention having the weight-average molecular weight of from $7.5\times10^3$ to $3.7\times10^4$, and the resins other than it are mixed, the resin of the present invention may preferably be in a content of at least 20% by weight, and more preferably at least 30% by weight, based on the total weight of the resins. In a content less than 20% by weight, it may be difficult to impart an appropriate wearability, making the effect against smeared images insufficient.

As the fluorine-containing resin particles used in the present invention, one, or two or more resins may preferably appropriately be selected from tetrafluoroethylene resin, trifluoroethylene resin, hexafluoropropylene resin, vinyl fluoride resin, vinylidene fluoride resin, difluorodichloroethylene resin, and copolymers of any of these. Among them, tetrafluoroethylene resin and vinylidene fluoride resin are particularly preferred. The molecular weight of the resin may appropriately be selected, without any particular limitations.

The fluorine-containing resin particles may preferably be in a content of from 0.1 to 50% by weight, and particularly preferably form 0.2 to 30% by weight, based on the weight of the whole solid content in the layer containing the particles. If the particles are in a content less than 0.1% by weight, the effect attributable to the fluorine-containing resin particles tends not to be sufficient. If in a content more than 50% by weight, a coating solution may have a poor long-term stability, or a lowering of light transmission properties and a lowering of carrier mobility tend to occur.

The fluorine-containing resin particles may preferably have a primary particle diameter of 0.3 μm or smaller, particularly preferably from 0.05 μm to 0.3 μm, and more preferably from 0.08 μm to 3.0 μm. If the fluorine-containing resin particles have a primary particle diameter larger than 0.3 μm, the fluorine-containing resin particles tend to settle in the coating solution to tend to cause a difficulty of making the coating solution have a poor long-term stability and poor coating properties since the present invention employs a binder resin having a relatively low molecular weight. If on the other hand the particles have a primary particle diameter smaller than 0.05 μm, the effect attributable to the addition of the particles may be attained with difficulty.

In the present invention, in order to improve the dispersibility of the fluorine-containing resin particles, it is more preferable to use a fluorine-containing comb graft polymer. The fluorine-containing comb graft polymer is a polymer obtained by copolymerizing with a fluorine-containing polymerizable monomer a macromonomer having a polymerizable functional group on one end of each molecular chain and having a relatively low molecular weight of from 1,000 to 10,000, and has a structure wherein polymers of macromonomers hang in plates from the backbone of the fluorine-containing polymer. As the macromonomer, those having an affinity for the resin to which the graft polymer is added are selected. For example, polymers or copolymers of acrylic esters, methacrylic esters or styrene compounds may be used. As for the fluorine-containing polymerizable monomer, one or more of polymerizable monomers having a fluorine atom on the side chain like those shown below may be used, but not limited thereto.

Exemplary Monomer 1

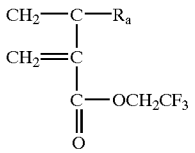

Exemplary Monomer 2

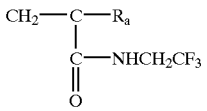

Exemplary Monomer 3

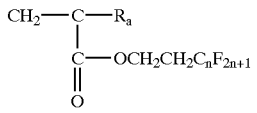

Exemplary Monomer 4

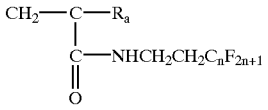

Exemplary Monomer 5

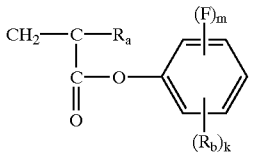

Exemplary Monomer 6

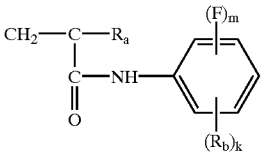

In the formulas, $R_a$ represents a hydrogen atom or a methyl group. $R_b$ represents a hydrogen atom, a halogen atom, an alkyl group, an alkoxyl group or a nitrile group, or a combination of any of these in plurality. Letter symbol n represents an integer of 1 or more, m an integer of 1 to 5, and k an integer of 1 to 4, provided that m+k=5.

The the alkyl group may include a methyl group, an ethyl group, a propyl group, a cyclohexyl group and a cycloheptyl group. The alkoxyl group may include a methoxyl group, an ethoxyl group and a propoxyl group. The halogen atom may include a fluorine atom, a chlorine atom and a bromine atom.

The fluorine-containing comb graft polymer may contain a fluorine-containing monomer residue in an amount of from 5 to 90% by weight, and more preferably from 10 to 70% by weight, of the fluorine-containing comb graft polymer. If the fluorine-containing monomer residue is less than 5% by weight, the effect of modification to make hydrophobic can not be well exhibited. If the fluorine-containing monomer residue is more than 90% by weight, the monomer may have a poor solubility with the macromonomer.

The fluorine-containing comb graft polymer may be in a content of from 0.01 to 20% by weight, and particularly preferably from 0.1 to 10% by weight, based on the wieght of the fluorine-containing resin particles. If it is in a content less than 0.01% by weight, the effect of modifying dispersibility may be insufficient. If it is in a content more than 20% by weight, the graft polymer may become present also in the bulk of a coating film to tend to cause, because of a problem of its compatibility with the resin, accumulation of residual potential when the electrophotographic process is repeatedly performed.

In the present invention, it is more preferable to add an antioxidant to the surface layer. The addition of an antioxidant enables prevention of the surface deposits and deterioration of resin by oxidation that are chiefly causative of smeared images, and hence the smeared images can be more effectively prevented from occurring.

As the antioxidant used in the present invention, hindered phenol type antioxidants and phosphorus type antioxidants are particularly preferred. These may each be used alone. Particularly preferably, the hindered phenol type antioxidant and the phosphorus type antioxidant may be used in combination.

If the antioxidant is in a too small content, its effect against smeared images may be insufficient. If it is in a too large content, it may make electrophotographic performance poor, e.g., may cause an increase in residual potential. Hence, its proper quantity must be selected. Stated specifically, it may preferably be in a content of from 0.01 to 30% by weight, and particularly from 0.1 to 20% by weight, based on the weight of the resin.

The electrophotographic photosensitive member used in the present invention is constituted as described below.

The electrophotographic photosensitive member in the present invention has a photosensitive layer which may be either of a single-layer type in which a charge-generating material and a charge-transporting material are contained in the same layer and a multi-layer type in which a charge transport layer containing a charge-transporting material and a charge generation layer containing a charge-generating material are functionally separated. In view of electrophotographic performance, the multi-layer type is preferred. What is also preferred is that the charge transport layer is provided on the charge generation layer and the charge transport layer is the surface layer. In the following description, this form is taken as an example.

The conductive support used in the present invention may be any of those having a conductivity. It may be made of metals such as aluminum and stainless steel, and metals, papers or plastics provided with conductive layers, and may have the shape of a sheet or a cylinder.

In the case when the exposure light is interfering light, a conductive layer may be provided on the conductive support for the purpose of preventing interference fringes caused by scattering, or covering scratches of the support. Such a conductive layer may be formed by coating a dispersion prepared by dispersing a conductive powder such as carbon black or metal particles in a binder resin, followed by drying. It is suitable for the conductive layer to have a layer thickness of from 5 to 40 $\mu$m, and particularly preferably from 10 to 30 $\mu$m.

An intermediate layer having the function of adhesion may be provided between the conductive support and the photosensitive layer. Materials for the intermediate layer may include polyamide, polyvinyl alcohol, polyethylene oxide, ethyl cellulose, casein, polyurethane and polyetherurethane. The intermediate layer may be formed by coating a solution prepared by dissolving any of these materials in a suitable solvent, followed by drying. It is suitable for the intermediate layer to have have a layer thickness of from 0.05 to 5 $\mu$m, and preferably from 0.3 to 1 $\mu$m.

The charge generation layer may be formed by coating a dispersion prepared by well dispersing a charge-generating material together with a suitable resin used in 0.3- to 4-fold weight and a solvent by means of a homogenizer, an ultrasonic dispersion machine, a ball mill, a vibration ball mill, a sand mill, an attritor, a roll mill or a liquid impact type high-speed dispersion machine, followed by drying. The charge-generating material used may include dyes of selenium-tellurium, pyrylium and thiapyrylium types, and pigments of phthalocyanine, anthanthrone, dibenzopyrenequinone, trisazo, cyanine, disazo, monoazo, indigo, quinacridone and unsymmetrical quinocyanine types. It is suitable for the charge generation layer to have a layer thickness of 5 μm or smaller, and preferably from 0.1 to 2 μm.

The charge transport layer may be formed by coating a coating fluid prepared by dissolving and dispersing a charge-transporting material and the resin and fluorine-containing resin particles of the present invention in a suitable solvent, followed by drying. The coating fluid may be prepared by a method in which the charge-transporting material and the resin and fluorine-containing resin particles of the present invention are simultaneously dissolved and dispersed in a solvent, or a method in which a coating fluid previously prepared by dissolving and dispersing the resin and fluorine-containing resin particles is mixed with a coating solution prepared by dissolving the charge-transporting material. The coating fluid may be prepared by simple mixing by agitation. If necessary, it may be prepared by using a dispersion means such as a ball mill, a roll mill, a sand mill or a high-pressure dispersion machine. It is so prepared that the fluorine-containing resin particles have a primary particle diameter of 0.3 μm or smaller.

The charge-transporting material used may include triarylamine compounds, hydrazone compounds, stilbene compounds, pyrazoline compounds, oxazole compounds, triarylmethane compounds and thiazole compounds. Any of these charge-transporting material may be used in combination with 0.5- to 2-fold weight of the resin. It is suitable for the charge transport layer to have a layer thickness of from 5 to 40 μm, and preferably from 15 to 30 μm.

As to the charging member the charging means used in the present invention has, there are no particular limitations on it so long as it is a contact charging member provided in contact with the electrophotographic photosensitive member and to which the voltage formed by superimposing an AC voltage on a DC voltage is applied. It may also have any shape of a roller, a blade and a brush. As for the voltage applied to the charging member, the DC voltage may preferably be from 200 to 2,000 V in absolute value, and the AC voltage may preferably have a peak-to-peak voltage of from 400 to 4,000 and a frequency of from 200 to 3,000 MHz.

The electrophotographic apparatus of the present invention may have, in addition to the electrophotographic photosensitive member and charging member described above, an exposure means, a developing means, a transfer means and optionally a cleaning means. There are no particular limitations on these exposure means, developing means, transfer means and cleaning means.

In the present invention, it is preferable to use a specific toner in view of making the present invention more effective and preventing toner from melt-adhering to the surface of the electrophotographic photosensitive member (melt-adhesion to drum) to cause faulty images (white dots or white lines in the case of reverse development). The white lines tend to remarkably occur especially when the resin having a relatively low molecular weight is used, as in the present invention.

More specifically, it is preferable to use a toner comprising toner particles and a first inorganic fine powder having a number-average particle diameter of 0.10 μm or smaller and a second inorganic fine powder having a number-average particle diameter of from 0.12 to 3.0 μm.

The toner particles contains at least a binder resin and a colorant.

As the binder resin for the toner particles used in the present invention, usable are, e,g, polystyrene; homopolymers of styrene derivatives such as poly-p-chlorostyrene and polyvinyltoluene; styrene copolymers such as a styrene-p-chlorostyrene copolymer, a styrene-vinyltoluene copolymer, a styrene-vinylnaphthalene copolymer, a styrene-acrylate copolymer, a styrene-methacrylate copolymer, a styrene-methyl a-chloromethacrylate copolymer, a styrene-acrylonitrile copolymer, a styrene-methyl vinyl ether copolymer, a styrene-ethyl vinyl ether copolymer, a styrene-methyl vinyl ketone copolymer, a styrene-butadiene copolymer, a styrene-isoprene copolymer and a styrene-acrylonitrile-indene copolymer; polyvinyl chloride, phenol resins, natural resin modified phenol resins, natural resin modified maleic acid resins, acrylic resins, methacrylic resins, polyvinyl acetate, silicone resins, polyester resins, polyurethane resins, polyamide resins, furan resins, epoxy resins, xylene resins, polyvinyl butyral, terpene resins, cumarone indene resins, and petroleum resins. Cross-linked styrene resins are also preferred binder resins.

Comonomers copolymerizable with styrene monomers in the styrene copolymers may include monocarboxylic acids having a double bond and derivatives thereof such as acrylic acid, methyl acrylate, ethyl acrylate, butyl acrylate, dodecyl acrylate, octyl acrylate, 2-ethylhexyl acrylate, phenyl acrylate, methacrylic acid, methyl methacrylate, ethyl methacrylate, butyl methacrylate, octyl methacrylate, acrylonitrile, methacrylonitrile and acrylamide; dicarboxylic acids having a double bond and derivatives thereof such as maleic acid, butyl maleate, methyl maleate and dimethyl maleate; vinyl esters such as vinyl chloride, vinyl acetate and vinyl benzoate; ethylenic olefins such as ethylene, propylene and butylene; vinyl ketones such as methyl vinyl ketone and hexyl vinyl ketone; and vinyl ethers such as methyl vinyl ether, ethyl vinyl ether and isobutyl vinyl ether. Any of these vinyl monomers may be used alone or in combination of two or more kinds. These may be cross-linked, and, as a cross-linking agent compounds having at least two polymerizable double bonds may chiefly be used. Stated specifically, they include aromatic divinyl compounds such as divinyl benzene and divinyl naphthalene; carboxylic acid esters having two double bonds, such as ethylene glycol diacrylate, ethylene glycol dimethacrylate and 1,3-butanediol dimethacrylate; divinyl compounds such as divinyl aniline, divinyl ether, divinyl sulfide and divinyl sulfone; and compounds having at least three vinyl groups. Any of these may be used alone or in the form of a mixture.

As a binder resin for the toner used in pressure fixing, it may include low-molecular weight polyethylene, low-molecular weight polypropylene, an ethylene-viny acetate copolymer, ethylene-acrylic ester copolymer, higher fatty acids, polyamide resins, and polyester resins. These may be used alone or in the form of a mixture.

The colorant usable in the present invention may include any suitable pigments and dyes. As the colorant for the toner, a pigment or a dye may be used. The pigment may include, e.g., carbon black, aniline black, acetylene black, Naphthol Yellow, Hanza Yellow, Rhodamine Lake, Alizarine Lake, red iron oxide, Phthalocyanine Blue and Indanethrene Blue. The pigment is used in a quantity necessary and sufficient for maintaining optical density of fixed images, and may be added in an amount of from 0.1 to 20 parts by weight, and preferably from 0.2 to 10 parts by weight, based on 100 parts by weight of the binder resin. The dye may include, e.g., azo dyes, anthraquinone dyes, xanthene dyes and methine dyes. The dye may be added in an amount of from 0.1 to 20 parts by weight, and preferably from 0.3 to 10 parts by weight, based on 100 parts by weight of the binder resin. A magnetic material may also be used as the colorant in the case when the toner is what is called a one-component toner, containing a magnetic material.

The first inorganic fine powder used in the present invention has a number-average particle diameter of 0.10 μm or smaller, and preferably from 0.005 to 0.07 μm. The second inorganic fine powder has a number-average particle diameter of from 0.12 to 3.0 μm, and preferably from 0.12 to 2.5 μm.

Both the first inorganic fine powder and the second inorganic fine powder have the effect of preventing smeared images in environment of high temperature and high humidity. In particular, the second inorganic fine powder has this effect greatly. The second inorganic fine powder also has the action to prevent image density from decreasing in the environment of high temperature and high humidity.

The first inorganic fine powder may preferably be slightly water-soluble, and may include, e.g., iron oxide, magnesium oxide and fine silicic acid powder. Fine silicic acid powder is particularly preferred.

If the first inorganic fine powder has a number-average particle diameter larger than 0.10 μm, the toner may have a low fluidity to tend to cause a decrease in image density. If on the other hand the first inorganic fine powder has a number-average particle diameter smaller than 0.005 μm, the first inorganic fine powder tends to become apart from toner particles to tend to cause filming on the photosensitive member surface.

The first inorganic fine powder may preferably further be subjected to coupling treatment, oil treatment or fatty acid treatment on its particle surfaces. In particular, from the view point of preventing melt-adhesion to drum and white lines, those having been subjected to coupling treatment and thereafter further to oil treatment may preferably be used. The treatment with oil may preferably be in such an amount that the oil is in a content of from 3 to 20% by weight based on the weight of the inorganic fine powder to be treated. If it is less than 3% by weight, the effect of preventing melt-adhesion to drum and white lines may be exhibited with difficulty, and if it is more than 20% by weight, smeared images tend to occur, undesirably.

The second inorganic fine powder may preferably be slightly water-soluble so that the charging performance of the toner does not lower in environment of high temperature and high humidity, and may include, e.g., iron oxide, chromium oxide, calcium titanate, strontium titanate, barium titanate, magnesium titanate, cerium oxide, zirconium oxide, aluminum oxide, titanium oxide, zinc oxide and calcium oxide. Preferably usable are strontium titanate, cerium oxide and titanium oxide.

If the second inorganic fine powder has a number-average particle diameter smaller than 0.12 μm, the effect of preventing smeared images may lower undesirably, and if it has a number-average particle diameter larger than 3.0 μm, white-line images tend to occur undesirably.

The above average particle diameter of particles of the first inorganic fine powder and second inorganic fine powder is a value measured in the following manner.

Using an electron microscope S-800 (manufactured by Hitachi Ltd.), particles of the first inorganic fine powder are photographed at 10,000 to 20,000 magnifications, and particles of the second inorganic fine powder are photographed at 1,000 to 20,000 magnifications. From the fine powder particles thus photographed, 100 to 200 particles are picked up at random in respect of 0.001 μm or larger particles for the first inorganic fine powder and in respect of 0.005 μm or larger particles for the second inorganic fine powder. Their diameters are measured using a measuring device such as a slide gauge, and averaged values are regarded as the number-average particle diameter of the first and second inorganic fine powder particles.

In the present invention, the first inorganic fine powder may preferably be in a content of from 0.5 to 2.5% by weight based on the weight of the toner. If the first inorganic fine powder is in a content less than 0.5% by weight, it may be difficult to impart a sufficient fluidity to the toner, obtaining an adequate image density with difficulty. If in a content more than 2.5% by weight, the melt-adhesion of toner to drum may become conspicuously worsened. On the other hand, the second inorganic fine powder may preferably be in a content of from 0.35 to 3.5% by weight based on the weight of the toner. If the second inorganic fine powder is in a content less than 0.35% by weight, a sufficient abrading effect may not be obtained, tending to cause smeared images. If in a content more than 3.5% by weight, the melt adhesion to drum may become apparently worsened.

In order to better achieve what is intended in the present invention for the problem to be solved, the particle size distribution of the toner may preferably be so controlled that the toner has a weight-average particle diameter of from 3.5 μm to 6.5 μm and particles having particle diameters of from 2.00 μm to 3.17 μm are in a content of from 5 to 40% by number. It the toner has a weight-average particle diameter smaller than 3.5 μm, the melt-adhesion to drum tends to occur undesirably. If it has a weight-average particle diameter larger than 6.5 μm, the smeared images tend to occur undesirably. If the particles having particle diameters of from 2.00 μm to 3.17 μm are in a content less than 5% by number, the smeared images tend to occur undesirably, and if they are in a content more than 40% by number, the melt-adhesion to drum tends to occur undesirably.

The weight-average particle diameter and particle size distribution of the toner are measured using Coulter counter Model TA-II (manufactured by Coulter Electronics, Inc.). Coulter Multisizer (manufactured by Coulter Electronics, Inc.) may also be used. As an electrolytic solution, an aqueous 1% NaCl solution is prepared using first-grade sodium chloride. For example, ISOTON R-II (manufactured by Coulter Scientific Japan Co.) may be used.

Stated specifically, as a dispersant 0.1 to 5 ml of a surface active agent, preferably an alkylbenzene sulfonate, is added to 100 to 150 ml of the above aqueous electrolytic solution, followed by further addition of 2 to 20 mg of a sample to be measured. The electrolytic solution in which the sample has been suspended is subjected to dispersion treatment for about 1 minute to about 3 minutes in an ultrasonic dispersion machine. The volume distribution and number distribution of the toner are calculated by measuring the volume and number of toner particles of 2.00 μm or larger by means of the measuring device, using an aperture of 100 μm as its aperture. Then the weight-based, weight average particle diameter (D4: the middle value of each channel is used as the representative value for each channel) determined from the volume distribution of toner particles, and the number-based proportion of particles of from 2.00 μm to 3.17 μm, determined from number distribution, are determined.

As channels, 13 channels are used, which are of 2.00 to less than 2.52 μm, 2.52 to less than 3.17 μm, 3.17 to less than 4.00 μm, 4.00 to less than 5.04 μm, 5.04 to less than 6.35 μm, 6.35 to less than 8.00 μm, 8.00 to less than 10.08 μm, 10.08 to less than 12.70 μm, 12.70 to less than 16.00 μm, 16.00 to less than 20.20 μm, 20.20 to less than 25.40 μm, 25.40 to less than 32.00 μm, and 32.00 to less than 40.30 μm.

A toner containing a magnetic material may preferably be used as the toner used in the present invention. Usable magnetic materials include metal oxides containing elements such as iron, cobalt, nickel, copper, magnesium, manganese, aluminum and silicon. In particular, those composed chiefly of iron oxide such as triiron tetraoxide or γ-iron oxide are preferred. From the viewpoint of improving the fluidity of toner and controlling chargeability, those containing silicon atoms are preferred. Especially when toner particles have a small diameter, the toner particles themselves have a low fluidity, and hence no sufficient fluidity can be attained by only adding the above inorganic fine powders in the present invention, making it impossible to attain good chargeability and making it difficult to achieve the object of the present invention in some cases. The silicon atoms may preferably be contained in an amount of from 0.2 to 2.0% by weight based on the weight of the magnetic material. If it is less than 0.2% by weight, no sufficient fluidity may be obtained to cause difficulties such as unsharp characters and decrease in solid black density. If it is more than 2.0% by weight, image density tends to decrease in environment of high temperature and high humidity. The silicon atoms may more preferably be in a content of from 0.3 to 1.7% by weight. Especially, more preferred is an instance where the silicon atoms are present on the surface of the magnetic material in an amount of from 0.05 to 0.5% by weight.

The silicon atoms may be incorporated in the form of a water-soluble silicon compound when the magnetic material is produced, or may be incorporated in the form of a silicon compound after the magnetic material is produced, filtered and dried, which is then made to stick to particle surfaces by means of a mix muller or the like. Particles of such a magnetic material may have a BET specific surface area, as measured by nitrogen gas absorption, of from 2 to 30 $m^2/g$, and particularly from 3 to 28 $m^2/g$. The particles may also preferably have a Mohs hardness of from 5 to 7.

As the shape of such magnetic particles, they may be octahedral, hexahedral, spherical, acicular or flaky. Octahedral, hexahedral, spherical or amorphous ones are preferred as having less anisotropy. In particular, magnetic particles having a sphericity ψ of 0.8 or above are preferred in order to improve image density. The magnetic particles may preferably have an average particle diameter of from 0.05 to 1.0 μm, more preferably from 0.1 to 0.6 μm, and particularly preferably from 0.1 to 0.4 μm.

The magnetic material may be contained in the toner in an amount of from 30 to 200 parts by weight, preferably from 60 to 200 parts by weight, and more preferably from 70 to 150 parts by weight, based on 100 parts by weight of the binder resin. If it is less than 30% by weight, the toner may have a poor transport performance, so that the toner layer on the developer carrying member tends to be formed unevenly to cause uneven images. Also, because of an increase in triboelectricity of magnetic toner, image density tends to decrease. If on the other hand the magnetic material is more than 200 parts by weight, the toner tends to have a low fixing performance.

In the toner used in the present invention, an organic metal compound may preferably be used as a charge control agent. Among organic metal compounds, a metal complex containing as a ligand or a counter ion an organic compound highly vaporizable and sublimable is useful.

Such a metal complex includes azo type metal complexes represented by the formula shown below.

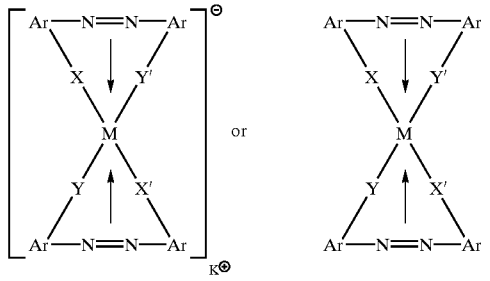

In the formula, M represents a central metal of coordination, including Cr, Co, Ni, Mn, Fe, Al, Ti, Sc and V in coordination number of 6. Ar represents an aryl group including a phenyl group and a naphthyl group, which may have a substituent. In such a case, the substituent includes a nitro group, a halogen atom, a carboxyl group, an anilido group, and an alkyl group or alkoxyl group having 1 to 18 carbon atoms. X, X', Y and Y' each represent —O—, —CO—, —NH— or —NR— (R is an alkyl group having 1 to 4 carbon atoms). $K^+$ represents a hydrogen ion, a sodium ion, a potassium ion, an ammonium ion, an aliphatic ammonium ion, or mixed ions of any of these.

Specific examples of the complexes preferably used in the present invention are shown below.

Formula (a)

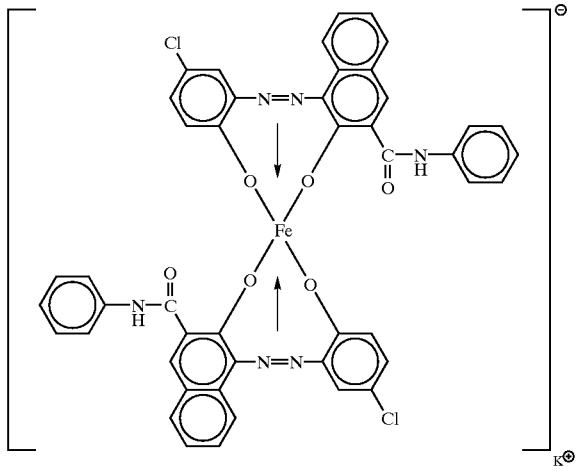

($K^+$ represents $H^+$, $Na^+$, $K^+$, $NH_4^+$, an aliphatic ammonium ion, or mixed ions of any of these.)

Formula (b)

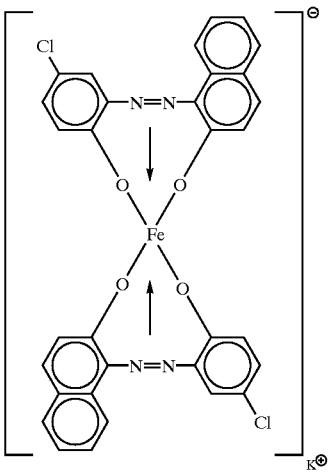

($K^+$ represents $H^+$, $Na^+$, $K^+$, $NH_4^+$, an aliphatic ammonium ion, or mixed ions of any of these.)

Formula (c)

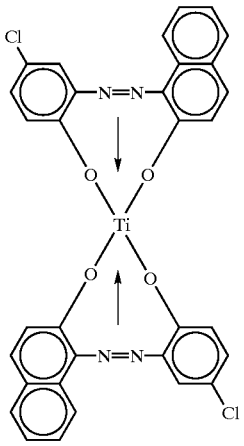

The charge control agent may preferably be added in an amount ranging from 0.2 to 5 parts by weight based on 100 parts by weight of the toner.

In the present invention, from the viewpoint of an improvement in releasability from a fixing member and an improvement in fixing performance, it is also preferable to incorporate into toner particles any of the following waxes, which include paraffin wax and derivatives thereof, microcrystalline wax and derivatives thereof, Fischer-Tropsch wax and derivatives thereof, polyolefin wax and derivatives thereof and carnauba wax and derivatives thereof. The derivatives may include oxides, block copolymers with vinyl monomers, and graft-modified products.

As other additives, it is also possible to use alcohols, fatty acids, acid amides, esters, ketones, hardened castor oil and derivatives thereof, vegetable waxes, animal waxes, mineral waxes, and pertrolatum.

The toner used in the present invention can be produced by a known process, e.g., by thoroughly mixing the binder resin, the wax, the metal salt or metal complex, the pigment or dye as the colorant or the magnetic material, and optionally the charge control agent and other additives by means of a mixing machine such as a Henschel mixer or a ball mill, thereafter melt-kneading the mixture using a heat kneading machine such as a heat roll, a kneader or an extruder to make resins melt one another to disperse or dissolve the metal compound, pigment, dye and magnetic material in the molten product, and solidifying the resulting dispersion or solution by cooling, followed by pulverization and classification. In the step of classification, a multi-division classifier may preferably be used in view of production efficiency.

To 100 parts by weight of toner particles obtained in the step of classification, an external additive comprising silica may be added and mixed in an amount ranging from about 1 to 10 parts by weight as the step of external addition and mixing. A preferable apparatus used in the step of external addition and mixing may include Henschel mixers manufactured by Mitsui Miike Engineering Corporation, having trade names of FM-500, FM-300, FM-75 and FM-10.

An example of an image forming apparatus is schematically shown in FIG. 1, with reference to which an image forming method will be described below.

Reference numeral 1 denotes a drum type electrophotographic photosensitive member, around which provided are a charging roller (charging member) 2 a primary charging means has, an exposure optical system 3, a developing means 4 having a toner carrying member 5, a transfer means 9 and a cleaning means 11.

In this image forming apparatus, the surface of the electrophotographic photosensitive member 1 is uniformly charged by the operation of the charging roller 2. Thereafter, the charged surface is exposed by the exposure optical system 3 to form an electrostatic latent image on the surface of the electrophotographic photosensitive member 1.

Next, on the surface of the toner carrying member 5 internally provided with a magnet, a toner coat layer is formed by a toner layer thickness regulating member 6, and the electrostatic latent image formed on the electrophotographic photosensitive member 1 is developed in a developing zone while applying an alternating bias, a pulse bias and/or a DC bias across a conductive substrate of the electrophotographic photosensitive member 1 and the toner carrying member 5 through a bias applying means 8. In FIG. 1, reference numeral 7 denotes an agitation means, and 13 a magnetic toner.

Transfer paper P is delivered to a transfer zone, where the toner image formed by development is electrostatically transferred to transfer paper P by a transfer means, transfer roller 9 while charging the transfer paper P from its back surface through a voltage applying means 10 to a polarity reverse to that of the toner.

In the foregoing description, the transfer roller 9 is used as the transfer means. Alternatively, it may be a contact charging means such as a transfer blade, or may also be a non-contact, corona transfer means. In view of an advantage that ozone is less produced by transfer, the contact charging means is preferred.

The transfer paper P to which the toner image has been transferred is passed through a heat-pressure roller fixing assembly 12, thus the toner image turns into a fixed image.

The toner remaining on the electrophotographic photosensitive member 1 after the transfer step is removed by the operation of a cleaning means cleaning blade 11 and collected in a cleaner 14. After the cleaning, the primary charging step and subsequent steps are repeated.

In the present invention, plural components among the constituents such as the electrophotographic photosensitive member, the developing means and the cleaning means may be joined integrally as an apparatus unit to make up a process cartridge so that this process cartridge is detachably mountable to the body of the apparatus. For example, the charging means and the developing means may be supported integrally in a cartridge together with the electrophotographic photosensitive member to form a process cartridge that is detachable as a single unit from the body of the apparatus through a guide means such as a rail provided in the body of the apparatus. Here, the cleaning means may be provided on the side of the process cartridge.

Figure 2:
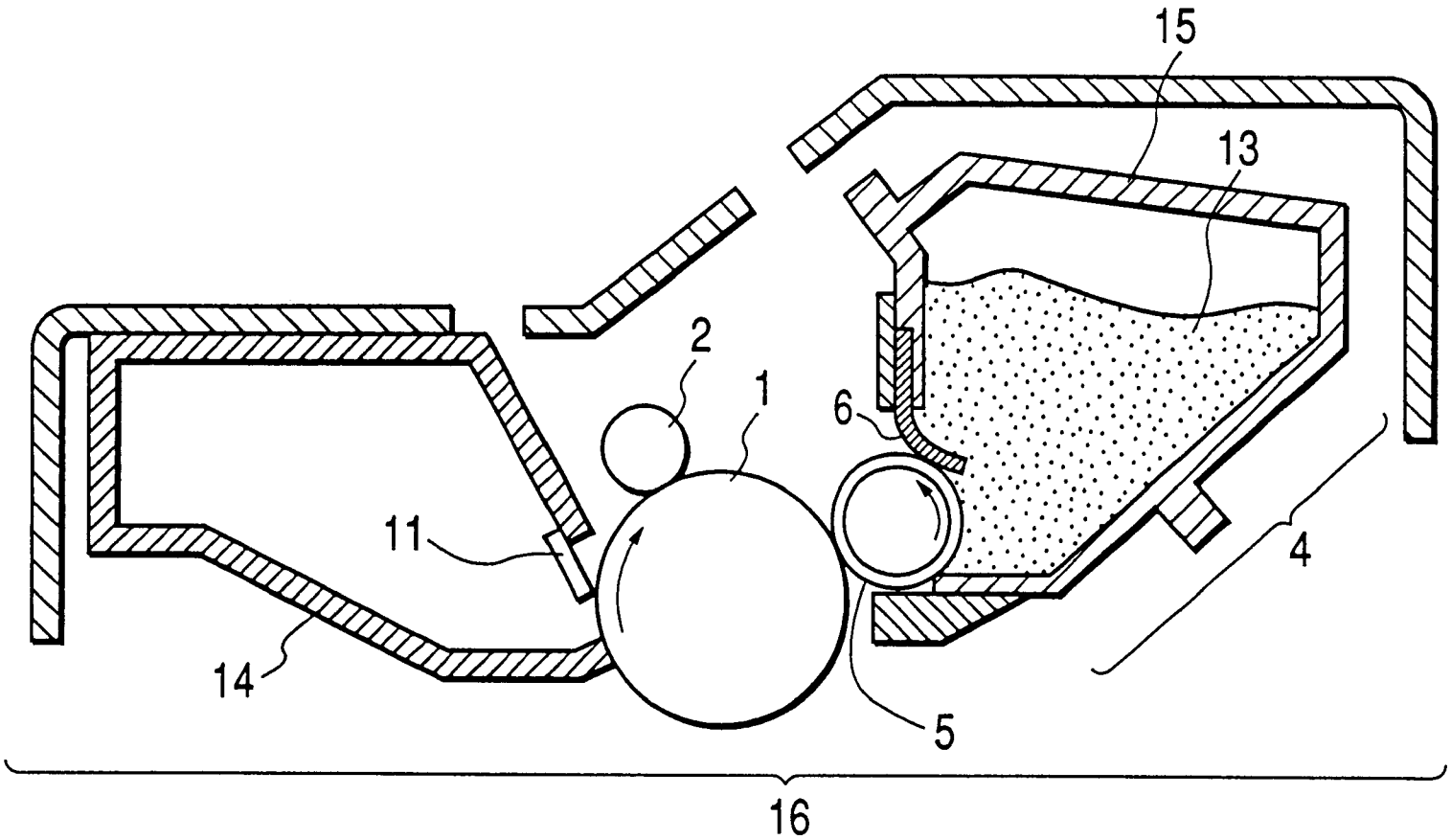
FIG. 2 schematically illustrates an example of the process cartridge of the present invention.

FIG. 2 shows an embodiment of the process cartridge according to the present invention. In this embodiment, a process cartridge 16 is exemplified in which a developing means 4, a drum type electrophotographic photosensitive member 1, a cleaner 14 having a cleaning blade 11, and a primary charging member 2 are joined integrally. This process cartridge is exchanged by a new cartridge when a magnetic toner 13 of the developing means 4 is used up.

In this embodiment, the developing means 4 holds the magnetic toner 13. At the time of development, a stated electric field is formed across the electrophotographic photosensitive member 1 and a toner carrying member developing sleeve 5. In order for the development to be preferably performed, the distance between the electrophotographic photosensitive member 1 and the developing sleeve 5 is very important.

In the process cartridge shown in FIG. 2, the developing means 4 has a toner container 15 which holds the magnetic toner 13, a developing sleeve 5 which carries and transports the magnetic toner 13 from the toner container 15 to the developing zone where it faces the electrophotographic photosensitive member 1, and an elastic blade 6 serving as a toner layer thickness regulating member by which the magnetic toner transported to the developing zone is regulated to form a toner thin layer on the developing sleeve.

The developing sleeve 5 may have any structure. In usual instances, it comprises a non-magnetic developing sleeve 5 internally provided with a magnet (not shown). The developing sleeve 5 may be a cylindrical rotating member as shown in FIG. 2. It may also be a belt which is set circulatively movable. As materials therefor, usually, it is preferable to use aluminum or stainless steel.

The elastic blade 6 may comprise an elastic plate formed of an elastic rubber such as urethane rubber, silicone rubber or NBR, an elastic metal such as phosphor bronze and stainless steel sheet, or an elastic resin such as polyethylene terephthalate or high-density polyethylene. The elastic blade 6 comes into touch with the developing sleeve 5 by its own elasticity, and is fastened to the toner container 15 by means of a support member comprising a rigid material such as iron. The elastic blade 6 may preferably come into touch with the developing sleeve 5 in the counter direction with respect to its rotational direction at a linear pressure of from 5 to 80 g/cm. In place of the elastic blade 6, a magnetic doctor blade such as an iron blade may also be used.

The present invention will be described below in greater detail by giving Examples. In the following Examples, "part(s)" refers to "part(s) by weight".

EXAMPLE 1

On an aluminum cylinder of 30 mm diameter and 254 mm long, a coating fluid comprised of the following materials was coated by dip coating, followed by heat-curing at 140° C. for 30 minutes to form a conductive layer with a layer thickness of 15 $\mu$m.

| | |
|---|---|
| Conductive pigment: $SnO_2$-coated barium sulfate | 10 parts |
| Resistance modifying pigment: Titanium oxide | 2 parts |
| Binder resin: Phenol resin | 6 parts |
| Leveling material: Silicone oil | 0.001 part |
| Solvent: Methanol/methoxypropanol (weight ratio: 0.2/0.8) | 20 parts |

Next, on this conductive layer, a solution prepared by dissolving 3 parts of N-methoxydimethylated nylon and 3 parts of copolymer nylon in a mixed solvent of 65 parts of methanol and 30 parts of n-butanol was coated by dip coating, followed by drying to form an intermediate layer with a layer thickness of 0.5 $\mu$m.

Next, 4 parts of oxytitanium phthalocyanine (TiOPc) having strong peaks at Bragg's angles 2θplus-minus 0.2° of 9.0°, 14.2°, 23.9° and 27.1° as measured by CuKα X-ray diffraction, 2 parts of polyvinyl butyral (trade name: S-LEC BM2; available from Sekisui Chemical Co., Ltd.) and 60 parts of cyclohexanone were dispersed for 4 hours by means of a sand grinder making use of glass beads of 1 mm diameter, followed by addition of 100 parts of ethyl acetate to obtain a charge generation layer forming dispersion. This dispersion was coated on the intermediate layer by dip coating, followed by drying to form a charge generation layer with a layer thickness of 0.3 $\mu$m.

Next, 10 parts of tetrafluoroethylene resin particles (trade name: LUBRON L-2; available from Daikin Industries, Ltd.), 10 parts of the resin of Condition No. 1 shown in Table 1 and 0.07 part of a fluorine-containing comb graft polymer (trade name: GF300; available from Toa Kasei K.K.) were thoroughly mixed with 60 parts of monochlorobenzene, followed by dispersion by means of a high-pressure dispersion machine, thus a tetrafluoroethylene resin particle dispersion was prepared. Here, the primary particle diameter of tetrafluoroethylene resin particles was measured with a particle size distribution measuring device (manufactured by Horiba Seisakusho) to find that the particle diameter was 0.25 $\mu$m.

Next, in a mixed solvent of 50 parts of monochlorobenzene and 50 parts of dichloromethane, 9 parts of an amine compound represented by the formula:

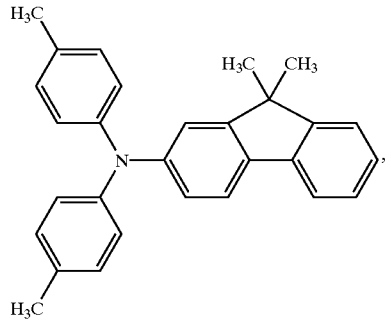

1 part of an amine compound represented by the formula:

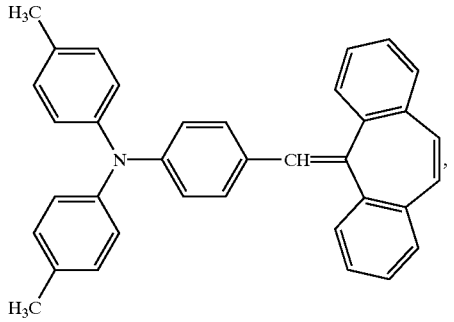

10 parts of the resin of Condition No. 1 shown in Table 1 and 5 parts of the above tetrafluoroethylene resin particle dispersion were dissolved. Weight-average molecular weight and degree of dispersion of this resin were measured to find that they were 35,000 and 2.8, respectively. Incidentally, this corresponds to Condition No. 1 in Table 1.

The resultant coating fluid was coated on the charge generation layer by dip coating, followed by drying at 120° C. for 2 hours to form a charge transport layer with a layer thickness of 25 μm.

Next, evaluation was made as described below. As an apparatus, a laser beam printer LASER JET 4 PLUS (process speed: 71 mm/sec), manufactured by Hullet Packard Co., having a roller contact charging means as a primary charging member was modified and put into use (DC voltage: −700 V; peak-to-peak voltage of AC voltage: 1.6 kV; frequency: 1 kHz). The apparatus was so modified that the controlling of primary charging was changed from constant-current control to constant-voltage control.

Using the electrophotographic photosensitive member produced as described above, a paper-feed running test was made using this apparatus in environment of 28° C./90%RH. Images were formed on A4-size sheets in a lattice pattern with a print image percentage of 4%. Sequence was set in an intermittent mode where copying was stopped once for each sheet. Toner was supplied when used up, and printing was repeated until any problem occurred on images, where the number of sheets on which the problem occurred was recorded. Visual appearance of the electrophotographic photosensitive member produced was also checked to examine whether or not it had any uneven coat surface and defects.

Next, the above modified apparatus was used to make a 2,000 sheet continuous paper-feed running test in environment of 33° C./95%RH, using paper with a moisture absorption of 10% (the moisture absorption was measured with MOISTREX MX5000, manufactured by Infrared Engineering), to make evaluation on smeared images. Images were formed on A4-size sheets in an E-letter pattern with a print image percentage of 4%. Evaluation was made by visually observing E-letter images at the initial stage, on the 2,000-sheet running, and upon leaving for 24 hours after the 2,000-sheet running. An instance where no smeared images occurred was evaluated as "A"; an instance where smeared images occurred but letters were legible, as "B"; an instance where letters were illegible, as "C"; and an instance where letters disappeared completely, as "CC".

The peak-to-peak voltage of the AC voltage in the above modified apparatus was changed to 1.9 kV, and a paper-feed running test was made in environment of 15° C./10%RH. Images were formed on A4-size sheets in a lattice pattern with a print image percentage of 4%. Sequence was set in an intermittent mode where copying was stopped once for each sheet. Running was made on up to 5,000 sheets. When any problem occurred on images, the number of sheets on which the problem occurred was recorded. Observation was made visually. Light-area potential at the initial stage and Light-area potential after 5,000-sheet running were measured.

The results are shown in Table 3.

EXAMPLES 2 to 12

Electrophotographic photosensitive members were produced in the same manner as in Example 1 except that the resin for the charge transport layer was replaced with the resins of Condition Nos. 2 to 12, respectively, shown in Table 2. Evaluation was made similarly. The results are shown in Table 3.

EXAMPLE 13

The procedure of Example 1 was repeated up to the formation of the charge generation layer.

To form a charge transport layer, 10 parts of tetrafluoroethylene resin particles (trade name: LUBRON L-2; available from Daikin Industries, Ltd.), 10 parts of the resin of Condition No. 11 shown in Table 1 and 0.07 part of a fluorine-containing comb graft polymer (trade name: GF300; available from Toa Kasei K.K.) were thoroughly mixed with 60 parts of monochlorobenzene, followed by dispersion by means of a high-pressure dispersion machine, thus a tetrafluoroethylene resin particle dispersion was prepared. Here, the primary particle diameter of tetrafluoroethylene resin particles was measured with a particle size distribution measuring device (manufactured by Horiba Seisakusho) to find that the particle diameter was 0.18 μm.

Next, in a mixed solvent of 50 parts of monochlorobenzene and 50 parts of dichloromethane, 9 parts and 1 part, 10 parts in total, of the amine compounds as used in Example 1, 10 parts of the resin of Condition No. 6 shown in Table 2, 15 parts of the above tetrafluoroethylene resin particle dispersion and 0.4 part of a hindered phenol type antioxidant represented by the formula:

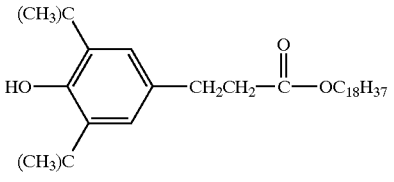

were dissolved. The resultant coating fluid was coated on the charge generation layer by dip coating, followed by drying at 120° C. for 2 hours to form a charge transport layer with a layer thickness of 25 μm.

The electrophotographic photosensitive member thus obtained was evaluated in the same manner as in Example 1. The results are shown in Table 3.

EXAMPLE 14

An electrophotographic photosensitive member was produced in the same manner as in Example 13 except that the antioxidant was replaced with 0.2 part of a hindered phenol type antioxidant represented by the formula:

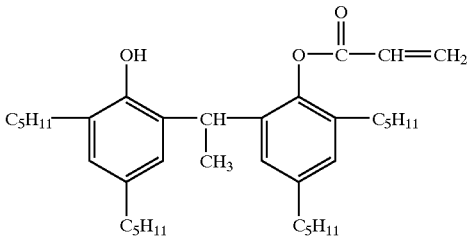

and 0.2 part of a phosphorus type antioxidant represented by the formula:

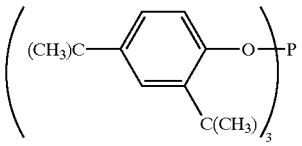

Evaluation was made similarly. The results are shown in Table 3.

EXAMPLE 15

An electrophotographic photosensitive member was produced in the same manner as in Example 1 except that the resin for the charge transport layer was replaced with the resin of Condition No. 5 shown in Table 1 and the ethylene resin particle dispersion was replaced with the tetrafluoroethylene resin particle dispersion described in Example 13. Evaluation was made similarly. The results are shown in Table 3.

EXAMPLE 16

An electrophotographic photosensitive member was produced in the same manner as in Example 12 except for using fluorine-containing resin particles having a primary particle diameter of 0.35 $\mu$m. Evaluation was made similarly. The results are shown in Table 3.

COMPARATIVE EXAMPLE 1

An electrophotographic photosensitive member was produced in the same manner as in Example 1 except that the resin for the charge transport layer was replaced with only the resin of Condition No. 13 shown in Table 1. Evaluation was made similarly. The results are shown in Table 4.

COMPARATIVE EXAMPLE 2

An electrophotographic photosensitive member was produced in the same manner as in Example 8 except that the fluorine-containing resin particles were not used. Evaluation was made similarly. The results are shown in Table 4.

COMPARATIVE EXAMPLE 3

An electrophotographic photosensitive member was produced in the same manner as in Example 1 except that the fluorine-containing resin particles were not used. Evaluation was made similarly. The results are shown in Table 4.

COMPARATIVE EXAMPLE 4

An electrophotographic photosensitive member was produced in the same manner as in Example 1 except that the resin for the charge transport layer was replaced with only the resin of Condition No. 14 shown in Table 1. Evaluation was made similarly. The results are shown in Table 4.

COMPARATIVE EXAMPLE 5

An electrophotographic photosensitive member was produced in the same manner as in Example 5 except that the fluorine-containing resin particles were not used. Evaluation was made similarly. The results are shown in Table 4.

EXAMPLE 17

A toner was produced in the following manner.

| | |
|---|---|
| Binder resin (a styrene resin) | 100 parts |
| Magnetic material ($Fe_3O_4$) | 100 parts |
| Charge control agent (a monoazo iron complex) | 2 parts |
| Wax (a polymeric alcohol type wax) | 5 parts |

A mixture of the above was melt kneaded using a twin extruder heated to 130° C., and the kneaded product obtained was cooled and then crushed by means of a hammer mill. The crushed product obtained was pulverized by means of a jet mill, followed by classification using an Elbow Jet classifier to obtain toner particles having the desired particle size distribution.

To 100 parts of the above toner particles, 1.5 parts of hydrophobic fine silica (silicon dioxide) powder having a number-average particle diameter of 0.02 $\mu$m as primary particles and having been surface-treated with a silane coupling agent and 0.3 part of fine strontium titanium powder having a number-average particle diameter of 1.80 $\mu$m as primary particles were added, and these were mixed by means of a Henschel mixer to obtain a toner. This toner had a weight-average particle diameter of 5.80 $\mu$m and contained 13% by number of particles having particle diameters of from 2.00 to 3.17 $\mu$m.

As the image forming apparatus shown in FIG. 1, fitted with the process cartridge shown in FIG. 2, laser beam printer LJ-5L, manufactured by Hullet Packard Co., was used. To the process cartridge of this LJ-5L, the electrophotographic photosensitive member produced in Example 1 and the above toner were set, and evaluation was made by the following image evaluation method.

The LJ-5L is an image forming apparatus comprising a contact charging roller coming into contact with the surface of the electrophotographic photosensitive member, used as a primary charging member, where charging voltage of a DC voltage of −625 V and an AC voltage of 1.8 kV as peak-to-peak voltage and 370 Hz in frequency is applied to the charging roller to charge the electrophotographic photosensitive member primarily.

(a) Evaluation in environment of high temperature/high humidity (33.0° C., 95%RH):

(1) Melt-adhesion to drum

Images with an image area percentage of about 3% were continuously printed on 2,500 sheets, and thereafter a solid black image was formed on the whole area of an A4-size recording paper to evaluate the extent to which white dots appeared on the solid black image.

A: No white dot occurs at all on the A4-size recording paper.

C: About 10 white dots occur on the A4-size recording paper.

E: At least 100 white dots occur on the A4-size recording paper.

B is on the level intermediate between A and C, and D between C and E.

(2) Smeared images

Images with an image area percentage of about 3% were continuously printed on 2,500 sheets. Evaluation was made according to the extent of smeared images. In this evaluation, sheets of paper making use of talc as a filler, on which smeared images tend to occur, were used as evaluation sheets. The paper had a moisture absorption of 10% at 33.0° C. and 95%RH. The moisture absorption of paper was measured with MOISTREX MX 5000, manufactured by Infrared Engineering.

A: No smeared images occur at all.

C: Smeared images occur, but letters are legible.

E: Smeared images occur, and letters are illegible.

B is on the level intermediate between A and C, and D between C and E.

(b) Evaluation in environment of low temperature/low humidity (15° C., 10%RH):

(1) White lines

Images with an image area percentage of about 3% were continuously printed on 2,500 sheets. The level of white lines was evaluated by examining a halftone image (one dot/two spaces in the secondary scanning direction) formed after the printing on 2,500 sheets.

A: No white lines occur at all.

C: White lines occur, but not clearly perceivable by the naked eye.

E: Many white lines are clearly perceivable by the naked eye.

illegible.

B is on the level intermediate between A and C, and D between C and E.

The results are shown in Table 5.

EXAMPLE 18

An electrophotographic photosensitive member was produced in the same manner as in Example 1 except that the resin for the charge transport layer was replaced with 6 parts (60% by weight of the whole resin) of the resin of Condition No. 2 shown in Table 1 and 4 parts (40% by weight of the whole resin) of the resin of Condition No. 10 shown in Table 1. Evaluation was made in the same manner as in Example 17. The results are shown in Table 5.

EXAMPLE 19

An electrophotographic photosensitive member was produced in the same manner as in Example 1 except that the resin for the charge transport layer was replaced with 4 parts (40% by weight of the whole resin) of the resin of Condition No. 6 shown in Table 1 and 6 parts (60% by weight of the whole resin) of the resin of Condition No. 11 shown in Table 1. Evaluation was made in the same manner as in Example 17 except for using a toner having a weight-average particle diameter of 6.8 $\mu$m and containing 3% by number of particles having particle diameters of from 2.00 to 3.17 $\mu$m and to which fine silicon dioxide powder was added in an amount of 1.2 parts based on 100 parts of the toner.

The results are shown in Table 5.

EXAMPLE 20

Images were formed and evaluated in the same manner as in Example 17 except that the electrophotographic photosensitive member was replaced with the one used in Example 19. The results are shown in Table 5.

EXAMPLE 21

The procedure of Example 1 was repeated up to the formation of the charge generation layer.

To form a charge transport layer, 10 parts of tetrafluoroethylene resin particles (trade name: LUBRON L-2; available from Daikin Industries, Ltd.), 10 parts of the resin of Condition No. 1 shown in Table 1 and 0.04 part of a fluorine-containing comb graft polymer (trade name: GF300; available from Toa Kasei K.K.) were thoroughly mixed with 60 parts of monochlorobenzene, followed by dispersion by means of a high-pressure dispersion machine, thus a tetrafluoroethylene resin particle dispersion was prepared. Here, the primary particle diameter of tetrafluoroethylene resin particles was measured with a particle size distribution measuring device (manufactured by Horiba Seisakusho) to find that the particle diameter was 0.18 $\mu$m.

Next, in a mixed solvent of 50 parts of monochlorobenzene and 50 parts of dichloromethane, 9 parts and 1 part, 10 parts in total, of the amine compounds as used in Example 1, 10 parts of the resin used in Example 19, 15 parts of the above tetrafluoroethylene resin particle dispersion, 0.2 part of the hindered phenol type antioxidant used in Example 14 and 0.2 part of the phosphorus type antioxidant used in Example 14 were dissolved to obtain a coating fluid. This coating fluid was coated on the charge generation layer by dip coating, followed by drying at 120° C. for 2 hours to form a charge transport layer with a layer thickness of 25 $\mu$m.

Using the electrophotographic photosensitive member thus obtained, images were formed and evaluated in the same manner as in Example 17. The results are shown in Table 5.

EXAMPLE 22

Images were formed and evaluated in the same manner as in Example 21 except that, in the production of the toner, the fine silica powder used in Example 17, surface-treated with a silane coupling agent, was further treated with silicone oil (viscosity: 100 cSt) in an amount of 20 parts based on 100 parts of the fine silica powder surface-treated with a silane coupling agent. The results are shown in Table 5.

EXAMPLE 23

Images were formed and evaluated in the same manner as in Example 21 except that the toner was produced using, in place of the fine strontium titanium powder, fine titanium oxide powder (number-average particle diameter of primary particles: 0.18 $\mu$m). The results are shown in Table 5.

COMPARATIVE EXAMPLE 5

An electrophotographic photosensitive member was produced in the same manner as in Example 19 except that the tetrafluoroethylene resin particles were not used and the charge transport layer was formed using as the resin 10 parts of only the resin of Condition No. 11 shown in Table 1. Evaluation was made similarly. The results are shown in Table 5.

COMPARATIVE EXAMPLE 6

An electrophotographic photosensitive member was produced in the same manner as in Example 19 except that the tetrafluoroethylene resin particles were not used and the charge transport layer was formed using as the resin 10 parts of only the resin of Condition No. 6 shown in Table 1. Evaluation was made similarly. The results are shown in Table 5.

EXAMPLE 24 toner was produced in the same manner as in Example 17 except that the fine strontium titanium powder was not used.

Images were formed and evaluated similarly. The results are shown in Table 5.

EXAMPLE 25

A toner was produced in the same manner as in Example 17 except that the fine strontium titanium powder was replaced with fine strontium titanium powder having a number-average particle diameter of 3.5 μm as primary particles. Images were formed and evaluated similarly. The results are shown in Table 5.

EXAMPLE 26

The toner was produced in the same manner as in Example 17 except that the fine strontium titanium powder was replaced with fine strontium titanium powder having a number-average particle diameter of 0.09 μm as primary particles. Images were formed and evaluated similarly. The results are shown in Table 5.

TABLE 1

| Condition No. | Structural unit: Monomer used | Structural unit: Molar fraction in resin | Structural unit: Monomer used | Structural unit: Molar fraction in resin | Weight-average molecular weight | Degree of dispersion |
|---|---|---|---|---|---|---|
| 1 | Exemplary Structural Unit (1)-1 | 100 | Exemplary Structural Unit (1)-2 | 50 | 35,000 | 2.8 |
| 2 | Exemplary Structural Unit (1)-1 | 100 | Exemplary Structural Unit (1)-24 | 30 | 10,000 | 2.4 |
| 3 | Exemplary Structural Unit (1)-1 | 50 | | | 33,000 | 3.0 |
| 4 | Exemplary Structural Unit (1)-1 | 70 | | | 25,000 | 3.4 |
| 5 | Exemplary Structural Unit (1)-4 | 100 | | | 18,000 | 2.2 |
| 6 | Exemplary Structural Unit (2)-2 | 100 | | | 12,000 | 1.9 |
| 7 | Exemplary Structural Unit (2)-2 | 100 | | | 36,000 | 2.1 |
| 8 | Exemplary Structural Unit (2)-1 | 100 | | | 35,000 | 2.0 |
| 9 | Exemplary Structural Unit (2)-1 | 100 | | | 12,000 | 1.8 |
| 10 | Exemplary Structural Unit (1)-1 | 100 | | | 75,000 | |
| 11 | Exemplary Structural Unit (2)-2 | 100 | | | 50,000 | |
| 12 | Exemplary Structural Unit (2)-1 | 100 | | | 100,000 | |
| 13 | Exemplary Structural Unit (1)-1 | 100 | | | 45,000 | |
| 14 | Exemplary Structural Unit (1)-1 | 100 | | | 6,000 | 1.7 |

TABLE 2

| Condition No. | Resin 1 (small molecular weight): Resin used (Condition No. in Table 1) | Resin 1: Proportion (% by weight) | Resin 2 (large molecular weight): Resin used (Condition No. in Table 1) | Resin 2: Proportion (% by weight) |
|---|---|---|---|---|
| 1 | 1 | 100 | | |
| 2 | 2 | 60 | 10 | 40 |
| 3 | 3 | 100 | | |
| 4 | 4 | 100 | | |
| 5 | 5 | 50 | 10 | 50 |
| 6 | 6 | 40 | 11 | 60 |
| 7 | 7 | 100 | | |

TABLE 2-continued

| Condition No. | Resin 1 (small molecular weight) Resin used (Condition No. in Table 1) | Resin 1 Proportion (% by weight) | Resin 2 (large molecular weight) Resin used (Condition No. in Table 1) | Resin 2 Proportion (% by weight) |
|---|---|---|---|---|
| 8 | 8 | 100 | | |
| 9 | 9 | 50 | 12 | 50 |
| 10 | 6 | 70 | 10 | 30 |
| 11 | 2 | 30 | 11 | 70 |
| 12 | 5 | 40 | 11 | 60 |

Terephthalic acid chloride and isophthalic acid chloride of the polymer represented by Formula (1) were in a mixing ratio of 1:1 in molar ratio.

TABLE 3

| | | | Evaluation on Smeared images | | | | | |
|---|---|---|---|---|---|---|---|---|
| | | | | | Leaving for 24 | 5,000 | Light-area potential | |
| Example: | Paper-feed running limit | Coating appearance | Initial stage | 2,000 sheets | hrs after 2,000 sheets | sheet running test | Initial stage (V) | After running (V) |
| 1 | Fogged on 21,000th sheet | Good | A | A | A | Good | −170 | −165 |
| 2 | Fogged on 20,000th sheet | Good | A | A | A | Good | −170 | −160 |
| 3 | Fogged on 20,000th sheet | Good | A | A | A | Good | −180 | −170 |
| 4 | Fogged on 19,000th sheet | Good | A | A | B | Good | −175 | −180 |
| 5 | Fogged on 20,000th sheet | Good | A | A | A | Good | −170 | −175 |
| 6 | Fogged on 19,000th sheet | Good | A | A | A | Good | −180 | −175 |
| 7 | Fogged on 17,000th sheet | Good | A | A | A | Good | −170 | −175 |
| 8 | Fogged on 16,000th sheet | Good | A | A | A | Good | −175 | −180 |
| 9 | Fogged on 18,000th sheet | Good | A | A | A | Good | −175 | −180 |
| 10 | Fogged on 19,000th sheet | Good | A | A | A | Good | −175 | −170 |
| 11 | Fogged on 18,000th sheet | Good | A | A | A | Good | −180 | −170 |
| 12 | Fogged on 19,000th sheet | Good | A | A | A | Good | −170 | −180 |
| 13 | Fogged on 25,000th sheet | Good | A | A | A | Good | −170 | −175 |
| 14 | Fogged on 27,000th sheet | Good | A | A | A | Good | −175 | −180 |
| 15 | Fogged on 22,000th sheet | Good | A | A | A | Good | −170 | −180 |
| 16 | Fogged on 16,000th sheet | Slightly uneven coating | A | A | B | Good | −180 | −185 |

TABLE 4

| | | | Evaluation on Smeared images | | | | | |
|---|---|---|---|---|---|---|---|---|
| | | | | | Leaving for 24 | 5,000 | Light-area potential | |
| Comparative Example: | Paper-feed running limit | Coating appearance | Initial stage | 2,000 sheets | hrs after 2,000 sheets | sheet running test | Initial stage (V) | After running (V) |
| 1 | Fogged on 24,000th sheet | Good | A | C | CC | Good | −185 | −190 |
| 2 | Fogged on 8,000th sheet Scratched on 3,000th sheet | Good | A | A | C | 3,000* | −170 | −230 |
| 3 | Fogged on 16,000th sheet Scratched on 15,000th sheet | Good | A | B | C | 3,500* | −175 | −230 |
| 4 | Fogged on 8,000th sheet Scratched on 2,000th sheet | Good | A | B | CC | 3,500* | −175 | −240 |
| 5 | Fogged on 15,000th sheet Scratched on 11,000th sheet | Good | A | B | C | 3,500* | −180 | −245 |

*Image density decreased after running on this number of sheets.

TABLE 5

| | Constitution of electrophotographic photosensitive member | | | | Constituion of toner | | | | | | |
|---|---|---|---|---|---|---|---|---|---|---|---|
| | | | | | Inorganic fine powder | | Toner | | | | |
| | Resin 1 Table 1, Condition No. (wt. %) | Resin 2 Table 1, Condition No. (wt. %) | F-containing resin particles | Antioxidant | First (number = average particle diameter) | Second (number = average particle diameter) | Weight aver. particle diam. (μm) | (I) (%) | Image quality (1) | (2) | (3) |
| Example: | | | | | | | | | | | |
| 17 | 1 (100) | — | Added | None | SCA-treated silicon dioxide (0.02 μm) | Strontium titanate (1.80 μm) | 5.8 | 13 | C | B | C |
| 18 | 2 (60) | 10 (40) | Added | None | SCA-treated silicon dioxide (0.02 μm) | Strontium titanate (1.80 μm) | 5.8 | 13 | C | B | C |
| 19 | 6 (40) | 11 (60) | Added | None | SCA-treated silicon dioxide (0.02 μm) | Strontium titanate (1.80 μm) | 6.8 | 3 | B | C | C |
| 20 | 6 (40) | 11 (60) | Added | None | SCA-treated silicon dioxide (0.02 μm) | Strontium titanate (1.80 μm) | 5.8 | 13 | C | B | C |
| 21 | 6 (40) | 11 (60) | Added | Added | SCA-treated silicon dioxide (0.02 μm) | Strontium titanate (1.80 μm) | 5.8 | 13 | C | A | C |
| 22 | 6 (40) | 11 (60) | Added | Added | SCA + SO-treated silicon dioxide (0.02 μm) | Strontium titanate (1.80 μm) | 5.8 | 13 | B | B | B |
| 23 | 6 (40) | 11 (60) | Added | Added | SCA + SO-treated silicon dioxide (0.02 μm) | Titanium oxide (1.80 μm) | 5.8 | 13 | B | B | B |
| Comparative Example: | | | | | | | | | | | |
| 5 | — | 11 (100) | None | None | SCA-treated silicon dioxide (0.02 μm) | Strontium titanate (1.80 μm) | 6.8 | 3 | C | E | A |
| 6 | 6 (100) | — | None | None | SCA-treated silicon dioxide (0.02 μm) | Strontium titanate (1.80 μm) | 6.8 | 3 | E | A | E |
| Example: | | | | | | | | | | | |
| 24 | 1 (100) | — | Added | None | SCA-treated silicon dioxide (0.02 μm) | — | 6.8 | 3 | C | C | C |
| 25 | 1 (100) | — | Added | None | SCA-treated silicon dioxide (0.02 μm) | Strontium titanate (3.50 μm) | 6.8 | 3 | C | B | C |
| 26 | 1 (100) | — | Added | None | SCA-treated silicon dioxide (0.02 μm) | Strontium titanate (0.09 μm) | 6.8 | 3 | C | C | C |

SCA: silane coupling agent; SO: silicone oil
(I): Content of particles with particle diameters of 2.00 to 3.17 μm
(1): Melt-adhesion to drum; (2): Smeared images; (3): White lines

What is claimed is:

1. A process cartridge comprising:

an electrophotographic photosensitive member comprising an electroconductive support and a photosensitive layer provided on the support; and a charging means having a charging member which is provided in contact with the electrophotographic photosensitive member and charges the electrophotographic photosensitive member electrostatically by applying a voltage formed by superimposing an alternating-current voltage on a direct-current voltage;

said electrophotographic photosensitive member and said charging means being supported as one unit and being detachably mountable to the main body of an electrophotographic apparatus; and said electrophotographic photosensitive member having a surface layer which contains i) a polycarbonate resin having a weight-average molecular weight of from $7.5\times10^3$ to $3.7\times10^4$, a degree of dispersion of 3.0 or less and having a structural unit represented by the following Formula (2), and ii) fluorine-containing resin particles (2)

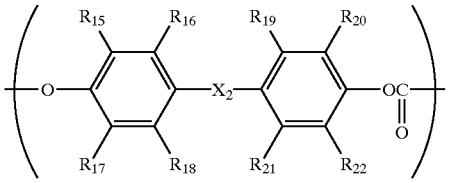

wherein $X_2$ represents —$CR_{23}R_{24}$— (where $R_{23}$ and $R_{24}$ are the same or different and each represent a hydrogen atom, a trifluoromethyl group, a substituted or unsubstituted alkyl group or a substituted or unsubstituted aryl group), a substituted or unsubstituted cycloalkylidene group, a substituted or unsubstituted α,ω-alkylene group, a single bond, —O—, —S—, —SO— or —$SO_2$—; and $R_{15}$ to $R_{22}$ are the same or different and each represent a hydrogen atom, a halogen atom, a substituted or unsubstituted alkyl group or a substituted or unsubstituted aryl group.

2. The process cartridge according to claim 1, wherein said surface layer of the electrophotographic photosensitive member further contains a polycarbonate resin of said Formula (2) having a weight-average molecular weight more than $3.7\times10^4$.

3. The process cartridge according to claim 1, wherein said fluorine-containing resin particles are selected from the group consisting of tetrafluoroethylene resin, trifluoroethylene resin, hexafluoropropylene resin, vinyl fluoride resin, vinylidene fluoride resin, difluorodichloroethylene resin, and a copolymer of any of these resins.

4. The process cartridge according to claim 1, wherein said surface layer of the electrophotographic photosensitive member further contains a fluorine-containing comb graft polymer.

5. The process cartridge according to claim 1, wherein said surface layer of the electrophotographic photosensitive member further contains an antioxidant.

6. The process cartridge according to claim 5, wherein said antioxidant is at least one of a hindered phenol antioxidant and a phosphorus antioxidant.

7. The process cartridge according to claim 1, which further comprises a developing means for forming a toner image by the use of a toner;

said toner having toner particles, a first inorganic fine powder having a number-average particle diameter of 0.10 μm or smaller and a second inorganic fine powder having a number-average particle diameter of from 0.12 μm to 3.0 μm.

8. The process cartridge according to claim 7, wherein said first inorganic fine powder is a fine silicic acid powder.

9. The process cartridge according to claim 8, wherein said second inorganic fine powder is selected from the group consisting of strontium titanate, cerium oxide and titanium oxide.

10. The process cartridge according to claim 7, wherein said first inorganic fine powder has been subjected to coupling treatment and thereafter oil treatment.

11. The process cartridge according to claim 7, wherein said second inorganic fine powder is selected from the group consisting of strontium titanate, cerium oxide and titanium oxide.

12. The process cartridge according to claim 7, wherein said toner has a weight-average particle diameter of from 3.5 μm to 6.5 μm and toner particles having particle diameters of from 2.00 μm to 3.17 μm in a content of from 5% by number to 40% by number of the whole toner.

13. The process cartridge according to claim 7, wherein said toner contains a magnetic material.

14. An electrophotographic apparatus comprising:

an electrophotographic photosensitive member comprising an electroconductive support and a photosensitive layer provided on the support;

a charging means having a charging Member which is provided in contact with the electrophotographic photosensitive member and charges an electrophotographic photosensitive member electrostatically by applying a voltage formed by superimposing an alternating-current voltage on a direct-current voltage;

an exposure means for exposing to light the electrophotographic photosensitive member charged, to form an electrostatic latent image;

a developing means for developing the electrostatic latent image by the use of a toner, to form a toner image; and transferring to a transfer medium the toner image formed;

said electrophotographic photosensitive member having a surface layer which contains i) a polycarbonate resin having a weight-average molecular weight of from $7.5\times10^3$ to $3.7\times10^4$, a degree of dispersion of 3.0 or less and having a structural unit represented by the following Formula (2), and ii) fluorine-containing resin particles (2)

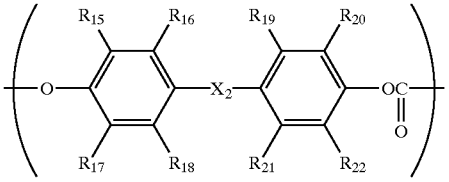

wherein $X_2$ represents —$CR_{23}R_{24}$— (where $R_{23}$ and R24 are the same or different and each represent a hydrogen atom, a trifluoromethyl group, a substituted or unsubstituted alkyl group or a substituted or unsubstituted aryl group), a substituted or unsubstituted cycloalkylidene group, a substituted or unsubstituted α,ω-alkylene group, a single bond, —O—, —S—, —SO— or —$SO_2$—; and $R_{15}$ to $R_{22}$ are the same or different and each represent a hydrogen atom, a halogen atom, a substituted or unsubstituted alkyl group or a substituted or unsubstituted aryl group.

15. The electrophotographic apparatus according to claim 14, wherein said surface layer of the electrophotographic photosensitive member further contains a polycarbonate resin of said Formula (2) having a weight-average molecular weight more than $3.7\times10^4$.

16. The electrophotographic apparatus according to claim 14, wherein said fluorine-containing resin particles are selected from the group consisting of tetrafluoroethylene resin, trifluoroethylene resin, hexafluoropropylene resin, vinyl fluoride resin, vinylidene fluoride resin, difluorodichloroethylene resin, and a copolymer of any of these resins.

17. The electrophotographic apparatus according to claim 14, wherein said surface layer of the electrophotographic photosensitive member further contains a fluorine-containing comb graft polymer.

18. The electrophotographic apparatus according to claim 14, wherein said surface layer of the electrophotographic photosensitive member further contains an antioxidant.

19. The electrophotographic apparatus according to claim 18, wherein said antioxidant is at least one of a hindered phenol antioxidant and a phosphorus antioxidant.

20. The electrophotographic apparatus according to claim 14, wherein said toner has toner particles, a first inorganic fine powder having a number-average particle diameter of 0.10 $\mu$m or smaller and a second inorganic fine powder having a number-average particle diameter of from 0.12 $\mu$m to 3.0 $\mu$m.

21. The electrophotographic apparatus according to claim 20, wherein said first inorganic fine powder is a fine silicic acid powder.

22. The electrophotographic apparatus according to claim 21, wherein said second inorganic fine powder is selected from the group consisting of strontium titanate, cerium oxide and titanium oxide.

23. The electrophotographic apparatus according to claim 20, wherein said first inorganic fine powder has been subjected to coupling treatment and thereafter oil treatment.

24. The electrophotographic apparatus according to claim 20, wherein said second inorganic fine powder is selected from the group consisting of strontium titanate, cerium oxide and titanium oxide.

25. The electrophotographic apparatus according to claim 20, wherein said toner has a weight-average particle diameter of from 3.5 $\mu$m to 6.5 $\mu$m and toner particles having particle diameters of from 2.00 $\mu$m to 3.17 $\mu$m in a content of from 5% by number to 40% by number of the whole toner.

26. The electrophotographic apparatus according to claim 20, wherein said toner contains a magnetic material.

* * * * *

UNITED STATES PATENT AND TRADEMARK OFFICE

CERTIFICATE OF CORRECTION

PATENT NO. : 6,405,005 B1
DATED : June 11, 2002
INVENTOR(S) : Wataru Kitamura et al.

It is certified that error appears in the above-identified patent and that said Letters Patent is hereby corrected as shown below:

Title page,
Item [56], FOREIGN PATENT DOCUMENTS,
"EP 0 903 604" should read -- EP 0 903 640 --.

Column 1,
Line 65, "result" should read -- result, --.

Column 2,
Line 13, "are smeared and" should be deleted.

Column 3,
Lines 13 and 34, "represent" should read -- represents --; and
Line 39, "≠,ω-alkylene" should read -- α,ω-alkylene --.

Column 4,
Line 44, "represent" should read -- represents --.

Column 5,
Line 39, "≠,ω-alkylene" should read -- α,ω-alkylene --.

Column 6,
Line 66, "Exemplary" should be deleted; and
Line 67, "Structural" should read -- Exemplary Structural --.

Column 10,
Line 20, "represent" should read -- represents --;
Line 42, "Exemplary" should be deleted; and
Line 43, "Structural" should read -- Exemplary Structural --.

Column 13,
Line 21, "$X_1$" should read -- $X_2$ --; and
Line 28, "represent" should read -- represents --.

Column 15,
Line 56, "wieght" should read -- weight --.

Column 17,
Line 64, "contains" should read -- contain --.

UNITED STATES PATENT AND TRADEMARK OFFICE

CERTIFICATE OF CORRECTION

PATENT NO. : 6,405,005 B1
DATED : June 11, 2002
INVENTOR(S) : Wataru Kitamura et al.

It is certified that error appears in the above-identified patent and that said Letters Patent is hereby corrected as shown below:

Column 18,
Line 6, "a-chloromethacrylate" should read -- α-chloromethacrylate --; and
Line 48, "ethylene-viny" should read -- ethylene-vinyl --.

Column 27,
Line 28, "Hullet" should read -- Hewlett --.

Column 30,
Line 40, "Hullet" should read -- Hewlett --.

Column 31,
Line 29, "illegible." should be deleted.

Column 32,
Line 66, "toner" should read -- A toner --.

Column 40,
Line 8, "Member" should read -- member --;
Line 39, "R24" should read -- $R_{24}$ --; and "represent" should read -- represents --; and
Line 46, "represent" should read -- represents --.

Signed and Sealed this

Nineteenth Day of August, 2003

JAMES E. ROGAN
*Director of the United States Patent and Trademark Office*